US010095136B2

(12) United States Patent
Sekiya et al.

(10) Patent No.: US 10,095,136 B2
(45) Date of Patent: Oct. 9, 2018

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Michiyo Sekiya, Atami (JP); Kunihiko Sekido, Suntou-gun (JP); Masashi Nishi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/587,290

(22) Filed: May 4, 2017

(65) Prior Publication Data

US 2017/0322501 A1 Nov. 9, 2017

(30) Foreign Application Priority Data

May 9, 2016 (JP) ..... 2016-094107

(51) Int. Cl.
*G03G 5/14* (2006.01)
*G03G 21/18* (2006.01)

(52) U.S. Cl.
CPC ..... *G03G 5/142* (2013.01); *G03G 5/14* (2013.01); *G03G 21/18* (2013.01); *G03G 2221/183* (2013.01)

(58) Field of Classification Search
CPC ..... G03G 5/144; G03G 5/142; G03G 5/14
USPC ..... 430/60, 64, 65
See application file for complete search history.

(56) References Cited

U.S. PATENT DOCUMENTS 5,998,072 A * 12/1999 Mochizuki ..... G03G 5/142 430/64
2015/0185637 A1* 7/2015 Nishi ..... G03G 5/142 430/60

FOREIGN PATENT DOCUMENTS

JP 2008-256843 A * 10/2008
JP 2014-29480 A 2/2014
JP 2015-143828 A 8/2015

OTHER PUBLICATIONS

Diamond, A.S., ed. Handbook of Imaging Materials, Marcel Dekker, Inc., NY (1991), pp. 395-396.*
Espacenet machine-assisted English language translation of JP 2008-256843 (pub. Oct. 2008).*
Taiseisha, Cross-linking Agent Handbook, 536-543, 594-605, 1981.

* cited by examiner

*Primary Examiner* — Janis L Dote
(74) *Attorney, Agent, or Firm* — Canon U.S.A. Inc., IP Division

(57) ABSTRACT

An electrophotographic photosensitive member includes a support member, an undercoat layer, and a photosensitive layer adjacent to the undercoat layer in this order, wherein the undercoat layer contains a polymerized product of a composition including an electron transporting material having a polymerizable functional group, a cross-linking agent, and a thermoplastic resin having a polymerizable functional group, and at least one type of particles selected from the group consisting of resin particles having a hollow structure and rubber particles, wherein a content of the electron transporting material in the undercoat layer is 30% by mass or more with respect to a total mass of the composition, and wherein a content of the at least one type of particles in the undercoat layer is 10% by mass or more and 100% by mass or less with respect to the content of the electron transporting material.

10 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

Aspects of the present disclosure generally relate to an electrophotographic photosensitive member, a process cartridge, and an electrophotographic apparatus.

Description of the Related Art

In electrophotographic processes, recently, hip volume printing and high-speed printing have been increasingly demanded, and, in response to this demand, high durability has also been demanded for electrophotographic photosensitive members. Moreover, along with realizing durability, there is also a demand for obtaining a high image quality by preventing holes from entering a photosensitive layer side from a support member side and facilitating movement of electrons from the photosensitive layer side to the support member side. To address these demands, Japanese Patent. Application. Laid-Open No. 2014-29480 and Japanese Patent Application Laid-Open No. 2015-143828 discuss a technique to provide an undercoat layer, which contains a cured product including an electron transporting material, between a support member and a photosensitive layer.

Japanese Patent Application Laid-Open No. 2014-29480 discusses that an undercoat layer contains a cured product obtained by polymerizing a composition including an electron transporting material, a cross-linking agent, and a resin. Japanese Patent. Application Laid-Open No. 2015-143828 discusses that an undercoat layer contains resin particles as well as a cured product obtained by polymerizing a composition including an electron transporting material and a cross-linking agent and that a protrusion is formed on the surface of the undercoat layer.

SUMMARY' OF THE INVENTION

According to an aspect of the present disclosure, an electrophotographic photosensitive member includes a support member, an undercoat layer, and a photosensitive layer adjacent to the undercoat layer in this order, wherein the undercoat layer contains a polymerized product of a composition including an electron transporting material having a polymerizable functional group, a cross-linking agent, and a thermoplastic resin having polymerizable functional group, and at least one type of particles selected from the group consisting of resin particles having a hollow structure and rubber particles, wherein a content of the electron transporting material in the undercoat layer is 30% mass or more with respect to a total mass of the composition, and wherein a content of the at least one type of particles in the undercoat layer is 10% by mass or more and 100% by mass or less with respect to the content of the electron transporting material.

According to another aspect of the present disclosure, an electrophotographic photosensitive member includes a support member, an undercoat layer, and a photosensitive layer adjacent to the undercoat layer in this order, wherein the undercoat layer contains a polymerized product of a composition including an electron transporting material having a polymerizable functional group, a cross-linking agent, and a thermoplastic resin having a polymerizable functional group, wherein a content of the electron transporting material in the undercoat layer is 30% mass or more with respect to a total mass of the composition, and wherein Martens hardness of the undercoat layer is 60 $N/mm^2$ or more and 150 $N/mm^2$ or less. According to a further aspect of the present invention, a process cartridge or an electrophotographic apparatus includes one of the above-mentioned electrophotographic photosensitive members.

Further features of the present disclosure will become apparent from the following description of exemplary embodiments with reference to the attached drawings.

DESCRIPTION OF THE EMBODIMENTS

Figure 1:
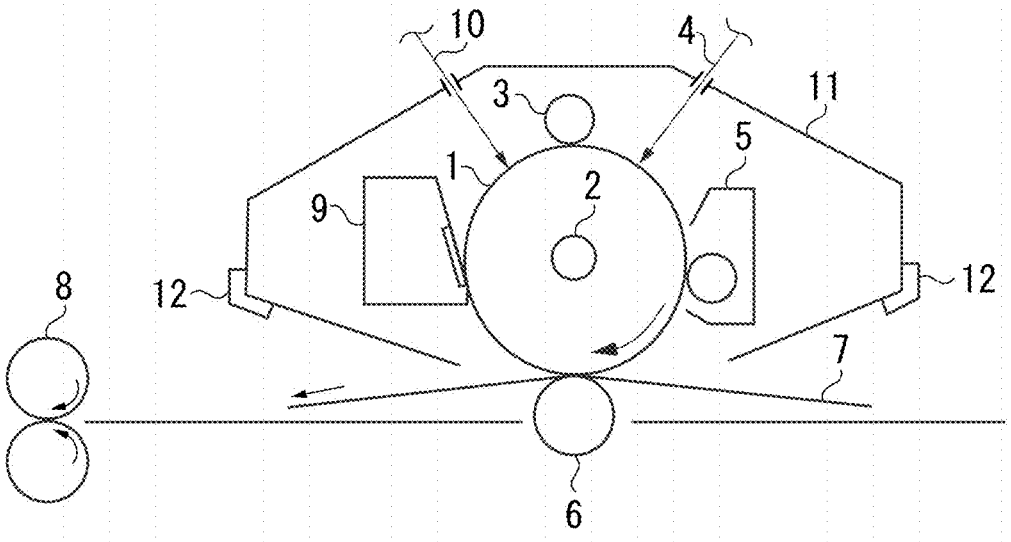
FIG. 1 illustrates a schematic configuration of an electrophotographic apparatus provided with a process cartridge including an electrophotographic photosensitive member.

In an examination by the present inventors, it was found that, in the electrophotographic photosensitive member discussed in the above-mentioned Japanese Patent Application Laid-Open No. 2014-29480 or Japanese Patent Application Laid-Open No. 2015-143828, since the undercoat layer contained a cured product having electron transportability, the adhesiveness thereof with a photosensitive layer serving as an upper layer thereof might be weakened.

Accordingly, aspects of the present disclosure are generally directed to providing an electrophotographic photosensitive member having high adhesiveness between an undercoat layer and a photosensitive layer even in a case where the undercoat layer contains cured product having electron transportability. Further aspects thereof are directed to providing a process cartridge and an electrophotographic apparatus each of which includes the electrophotographic photosensitive member.

As mentioned above, the undercoat layer containing a cured product may weaken the adhesiveness thereof with a photosensitive layer serving as an upper layer thereof. As a result of an examination by the present inventors, it was revealed that this was because the layer itself was hardened by curing and the electron transporting materials were stacked with each other due to their high-planarity structure so that internal stress increased in each layer. Furthermore, even in a case where resin particles were further contained in the undercoat layer, as discussed in Japanese Patent Application Laid-Open No. 2015-143828, it was found that the undercoat layer itself did not become sufficiently flexible.

Therefore, the present inventors examined various contrivances for improving the adhesiveness between the undercoat layer and the photosensitive layer while attaining, along with durability, prevention of electrons from entering a photosensitive layer side from a support member side and facilitation of movement of electrons from the photosensitive layer side to the support member side, and, as a result, arrived at configurations of the present disclosure.

In other words, the present inventors found out that all of the advantageous effects of the present disclosure were able to be attained concurrently by causing the undercoat layer to further contain at least one type of particles selected from the group consisting of resin particles having a hollow structure and rubber particles (hereinafter also referred to simply as "particles") and bringing the content of an electron transporting material and the content of particles (the mass ratio with respect to the content of an electron transporting material) in the undercoat layer into respective predetermined ranges. In this instance, merely causing the particles to be contained is not sufficient to attain prevention of electrons from entering the photosensitive layer side from the support member side and facilitation of movement of electrons from the photosensitive layer side to the support member side. This is because the existence of the particles may disturb the above advantageous effects. In aspects of the present invention, since the content of the electron transporting material in the undercoat layer is 30% by mass or more with respect to the total mass of the composition, and the content of the particles in the undercoat layer is 10% by mass or more and 100% by mass or less with respect to the content of the electron transporting material, an electrophotographic photosensitive member having high adhesiveness between the undercoat layer and the photosensitive layer can be obtained while attaining, along with durability, prevention of electrons from entering a photosensitive layer side from a support member side and facilitation of movement of electrons from the photosensitive layer side to the support member side. Furthermore, since the effect of improving mobility of electrons from the photosensitive layer side to the support member side correlates with the effect of preventing a ghost phenomenon (a phenomenon in which, at the time of forming one image, in a case where a portion irradiated with light becomes a halftone image at the next turn of the electrophotographic photosensitive member, the density of only the portion irradiated with light appears in a different way), an evaluation is performed based on the degree of ghost prevention effect.

[Electrophotographic Photosensitive Member]

The electrophotographic photosensitive member according to an exemplary embodiment includes a support member, an undercoat layer, and a photosensitive layer adjacent to the undercoat layer in this order.

The electrophotographic photosensitive member can be produced by applying each of the coating liquids prepared for forming the layers thereof, which are described below, in an intended order of layers, and drying the coatings. The coating liquids can be applied by a dipping (dip coating) method, a spray coating method, an inkjet method, a roll coating method, a die coating method, a blade coating method, a curtain coating method, or a spin coating method. From the viewpoint efficiency and productivity, the dipping method is desirable.

Hereinafter, each layer is described.

<Support Member>

In the present exemplary embodiment, it is desirable that the electrophotographic photosensitive member include a support member. Examples of the shape of the support member include a cylindrical shape, a belt shape, and a film shape. It is desirable that the support member have electrical conductivity.

The support member is made of, for example, a metal, such as aluminum, iron, nickel, copper, gold, or stainless steel, or an alloy thereof. Alternatively, the support member can be made of a resin, such as polyester, polyethylene, polypropylene, polyurethane, silicone resin, fluorine resin, polyimide, polyamide, polystyrene, vi chloride, polyacetal, polycarbonate, phenol resin, polysulfone, polyether sulfide, and polyphenylene sulfide, or glass. The resin or glass can be made to have electrical conductivity by applying, for example, blending, coating, or vapor deposition using, for example, a metal, such as aluminum, chrome, gold, and silver, a metal oxide, such as indium oxide, tin oxide, zinc oxide, and titanium oxide, carbon black, or an ionic conductive material.

The support member can be subjected to, for example, electrochemical treatment such as anode oxidization, blast treatment, or cutting treat ent.

<Electroconductive Layer>

In the present exemplary embodiment, an electroconductive layer can be provided on the support member.

The average film thickness of the electroconductive layer can be desirably in the range of 2 μm to 40 μm, or more desirably in the range of 10 μm to 30 μm.

It is desirable that the electroconductive layer contain metal oxide particles and a binder resin.

Examples of the metal oxide of the metal oxide particles include zinc oxide, white lead, aluminum oxide, indium oxide, silicon oxide, zirconium oxide, tin oxide, titanium oxide, magnesium oxide, antimony oxide, bismuth oxide, tin-doped indium oxide, antimony- or tantalum-doped tin oxide, and zirconium oxide. In these metal oxide particles, particles of zinc oxide, titanium oxide, or tin oxide are desirable.

The number average particle size of the metal oxide particles can be desirably in the range of 30 nm to 450 nm, more desirably in the range of 30 nm to 250 nm, from the viewpoint of preventing local formation of conductive paths that is a cause of black points. Moreover, the metal oxide particles can be surface-treated with, for example, a silane coupling agent so as to be highly dispersed. Furthermore, the metal oxide particles can be doped with another metal or metal oxide to regulate the resistance of the electroconductive layer.

Examples of the binder resin include a polyester resin, a polycarbonate resin, a polyvinyl butyral resin, an acrylic resin, a silicone resin, an epoxy resin, a melamine resin, a urethane resin, a phenol resin, and an alkyd resin.

The electroconductive layer can be formed applying a coating liquid prepared for the electroconductive layer onto the support member. The coating liquid for the electroconductive layer can contain a solvent in addition to the metal oxide particles and the binder resin. Examples of the solvent include an alcohol-based solvent, a sulfoxide-based solvent, a ketone-based solvent, an ether-based solvent, an ester-based solvent, and an aromatic hydrocarbon solvent. The metal oxide particles are dispersed in the coating liquid by using, for example, a paint shaker, a sand mill, a ball mill, or a high-speed liquid collision disperser.

<Undercoat Layer>

In the present exemplary embodiment, an undercoat layer is provided on the support member or the electroconductive layer.

In the present exemplary embodiment, the undercoat layer contains a polymerized product of a composition including an electron transporting material having a polymerizable functional group, a cross-linking agent, and a thermoplastic resin having a polymerizable functional group, and at least one type of particles selected from the group consisting of resin particles having a hollow structure and rubber particles.

The average film thickness of the undercoat layer can be desirably in the range of 0.3 μm to 10 μm, or more desirably in the range of 0.5 μm to 3 μm. The average film thickness of the undercoat layer is desirably 1/40 or more and 1/10 or less of the average film thickness of the entire photosensitive layer.

In the present exemplary embodiment, Martens hardness of the undercoat layer is desirably 60 Ni mm or more and 150 N/mm$^2$ or less. With the Martens hardness set in this range, high adhesiveness can be obtained. In the present embodiment, the Martens hardness is measured by a microhardness measurement apparatus directly reading the indentation depth obtained by continuously applying load to an indenter.

The undercoat layer can be formed by applying a coating liquid for forming the undercoat layer containing a composition including an electron transporting material having a polymerizable functional group, a cross-linking agent, and a thermoplastic resin having a polymerizable functional group and particles, and heating and drying the coating. The temperature used for heating and drying is desirably in the range of 100° C. to 200° C.

(1) At Least One Type of Particles Selected from the Group Consisting of Resin Particles Having a Hollow Structure and Rubber Particles In the present exemplary embodiment, the average particle size of the particles is desirably 0.01 μm or more, or more desirably 0.2 μm or more. Furthermore, the average particle size of the particles is desirably 1 μm or less, more desirably 0.6 μm or less, or particularly desirably 0.3 μm or less. The average particle size of the particles can be measured by using a dynamic light scattering method. For example, the particles are dispersed in an appropriate analyzer FPAR-1000 (manufactured by Otsuka Electronics Co., Ltd.) is used to prepare a particle size distribution of the particles by mass standard and set a median diameter $D_{50}$ thereof as the average particle size to be measured. At this time, the articles are dispersed by using, for example, a homogenizer, an ultrasonic disperser, a ball mill, a sand mill, a roll mill, or a vibration mill.

The average particle size of the particles desirably 1/10 or more and 1/3 or less of the film thickness of the undercoat layer. If the average particle size is less than 1/10, the effect of improving adhesiveness may not be able to be sufficiently obtained, and, if the average particle size is larger than 1/3, the ghost prevention effect may not be able to be sufficiently obtained.

The content of the particles in the undercoat layer is desirably 10% by mass or more and 100% by mass or less with respect to the content of the electron transporting material. Furthermore, that content is desirably 20% by mass or more and 60% by mass or less.

It is desirable that the particles in the undercoat layer be dispersed in a homogeneous manner.

In the present exemplary embodiment, the particles can react with an electron transporting material having a polymerizable group or a thermoplastic resin having a polymerizable functional group so as to polymerize.

(2-1) Resin Particles Having a Hollow Structure

In the present exemplary embodiment, the type of particles having a hollow structure is not specifically limited. Examples of the type include styrene resin particles, styrene/acrylic copolymer resin particles, vinylidene chloride/acrylonitrile copolymer resin particles, melamine resin particles, and urethane resin particles. These types of particles can be used independently alone or with two more types in combination. Among these, styrene/acrylic copolymer resin particles are desirable from the viewpoint of flexibility.

In the present exemplary embodiment, articles "having a hollow structure" refer to each particle having therein a single or a plurality of hole portions. From the viewpoint of flexibility, the volume of the hollow structure (hollow volume ratio) is desirably 30% by volume or more of that of the whole particle. The hollow volume ratio was calculated by a stereology method using the area of the hollow structure portion of the particle and the total cross-sectional area in the cross-section of the undercoat layer as "(the sum of areas of the hollow structure portions)/(the total cross-sectional area)×100". More specifically, the calculation was performed according to the following procedure.

An electrophotographic photosensitive member sample was embedded in an acrylic resin of the ultraviolet type and then cured, and, subsequently, an ultrathin film section was prepared by using an ultramicrotome. After that, this section was observed with a transmission electron microscope of the Hitachi H-7500 acceleration voltage 100 kV type and was then photographed at a magnification of 5,000 times. The captured image information was read at a resolution of 600 dpi via an interface and was then introduced into an image analysis apparatus WinROOF Version 5.0 (manufactured by Microsoft), and the sum of areas of the hollow structure portions was calculated. At that time, the measurement was performed in the range of 100 measured particles. In a case where the number of particles in the same image was less than 100, the calculation was similarly performed using a plurality of images.

Examples of the resin particles having a hollow structure include styrene/acrylic copolymer resin particles, such as SX866A (manufactured by JSR, hollow volume ratio: 30%), ROPAQUE HP-1055 (manufactured by ROHM AND HAARS, hollow volume ratio: 55%), and NIPOL MH5055 (manufactured by Nippon Zeon, hollow volume ratio: 55%).

(2-2) Rubber Particles

In the present exemplary embodiment, the type of rubber particles is not specifically limited. Examples of the type include butadiene rubber particles, styrene/butadiene copolymer rubber particles, acrylonitrile/butadiene copolymer rubber particles, saturated rubber particles obtained by hydrogenating or partially hydrogenating these diene rubbers, isoprene rubber particles, chloroprene rubber particles, natural rubber particles, silicon rubber particles, ethylene/propylene/diene monomer ternary copolymer rubber particles, acrylic rubber particles, and acrylic/silicone complex rubber particles. These types of rubber particles can be used independently alone or with two or more types in combination. Among these, from the viewpoint of flexibility, at least one type of rubber particles selected from the group consisting of butadiene rubber particles, acrylic rubber particles, and acrylic/silicone complex rubber particles is desirable.

Furthermore, from the viewpoint of the ghost prevention effect, it is desirable that the rubber particles be rubber particles having a core-shell structure. More specifically, such a structure that the core is rubber and the shell is harder resin is desirable. The resin used for the shell can be selected as appropriate from the viewpoint of compatibility with the rubber of the core and dispersibility.

Examples of the type of the rubber particles include:

rubber particles having a core-shell structure, such as Staphyroid AC3832 and AC3816N (manufactured by Ganz Chemical), METABLEN KW-4426 (manufactured by Mitsubishi Rayon), and XL-2655 (manufactured by ROHM AND HAARS);

acrylonitrile/butadiene copolymer rubber particles such as XER-91 (manufactured by JSR);

styrene/butadiene copolymer rubber particles such as XSK-500 (manufactured by JSR); and acrylic rubber particles such as METABLEN W-300A and W-450A (manufactured by Mitsubishi Rayon).

(2) Polymerized Product of a Composition Including an Electron Transporting Material Having a Polymerizable Functional Group, a Cross-linking Agent, and a Thermoplastic Resin Having a Polymerizable Functional Group Hereinafter, the electron transporting material, the cross-linking agent, and the resin are described.

(1) Electron Transporting Material

In the present exemplary embodiment, the content of the electron transporting material in the undercoat layer needs to be 30% by mass or more of the total mass of the composition. Furthermore, the content is desirably 70% by mass or less. If the content is more than 70% by mass, elution may occur, and the ghost prevention effect may not be able to be sufficiently obtained.

Examples of the electron transporting material include quinone compound, an imide compound, a benzimidazole compound, and a cyclopentadienylidene compound. It is desirable that the electron transporting material have a polymerizable functional group, such as a hydroxy group, a thiol group, an amino group, carboxyl group, and a methoxy group. In the present exemplary embodiment, it is desirable that the electron transporting material be at least one compound selected from the group consisting of co pounds represented by the following formulae (A1) to (A11):

(A1)

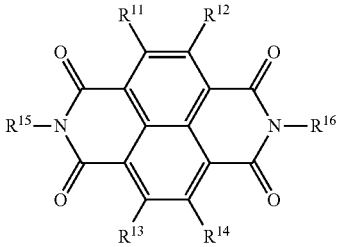

(A2)

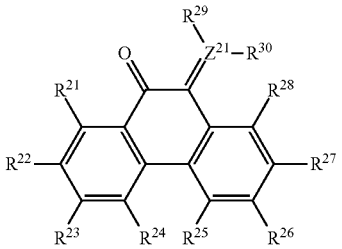

(A3)

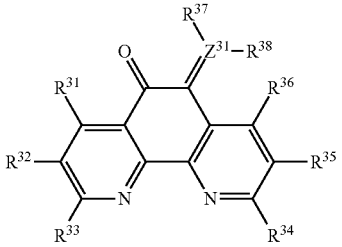

(A4)

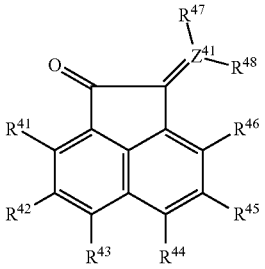

-continued (A5)

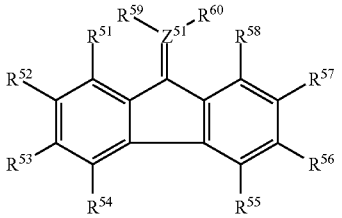

(A6)

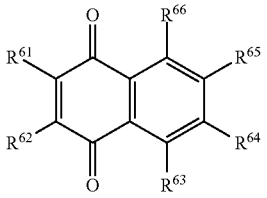

(A7)

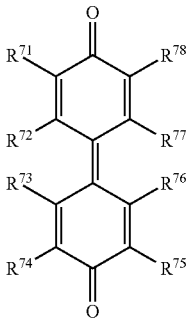

(A8)

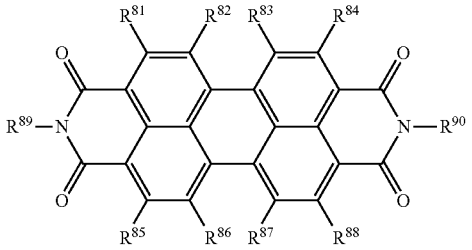

(A9)

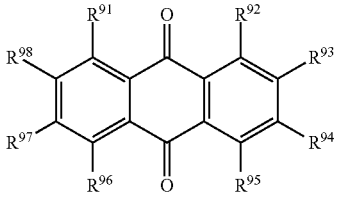

(A10)

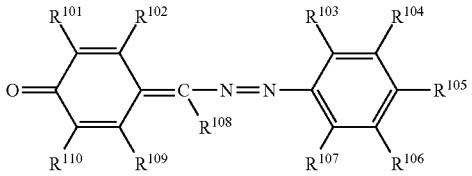

-continued (A11)

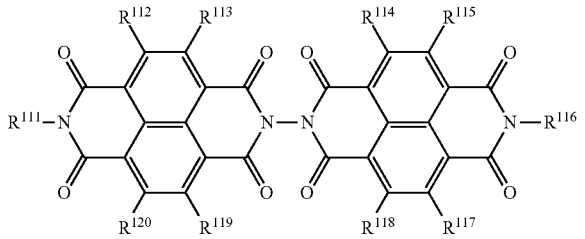

In general formulae (A1) to (A11), at least one of $R^{11}$ to $R^{16}$, at least one of $R^{21}$ to $R^{30}$, at least one of $R^{31}$ to $R^{38}$, at least one of $R^{41}$ to $R^{48}$, at least one of $R^{51}$ to $R^{60}$, at least one of $R^{61}$ to $R^{66}$, at least one of $R^{71}$ to $R^{78}$, at least one of $R^{81}$ to $R^{90}$, at least one of $R^{91}$ to $R^{98}$, at least one of $R^{101}$ to $R^{110}$, and at least one of $R^{111}$ to $R^{120}$ each are a monovalent group represented by the following general formula (A), and each of the other Rs is independently one of a hydrogen atom, a cyano group, a nitro group, a halogen atom, an alkoxycarbonyl group, an alkyl group, an aryl group, a heterocyclic ring, and a group with one of $CH_2$ in the main chain of an alkyl group substituted by one of O, S, NH, and $NR^{121}$ ($R^{121}$ being an alkyl group). The alkyl group, the aryl group, and the heterocyclic ring each can further have a substituent group. Examples of the substituent group for the alkyl group include an alkyl group, an aryl group, a halogen atom, and an alkoxycarbonyl group. Examples of the substituent group for the aryl group or the heterocyclic ring include a halogen atom, a nitro group, cyano group, an alkyl group, a halogen-substituted alkyl group, and an alkoxy group.

$Z^{21}$, $Z^{31}$, $Z^{41}$, and $Z^{51}$ each independently represent one of a carbon atom, a nitrogen atom, and an oxygen atom. In a case where $Z^{21}$ is an oxygen atom, $R^{29}$ and $R^{30}$ do not exist, and, in a case where $Z^{21}$ s a nitrogen atom, $R^{30}$ does not exist. In a case where $Z^{31}$ is an oxygen atom, $R^{37}$ and $R^{38}$ do not exist, and, in a case where $Z^{31}$ is a nitrogen atom, $R^{38}$ does not exist. In a case where $Z^{41}$ is an oxygen atom, $R^{47}$ and $R^{48}$ do not exist, and, in a case where $Z^{41}$ is a nitrogen atom, $R^{48}$ does not exist. In a case where $Z^{51}$ is an oxygen atom, $R^{59}$ and $R^{60}$ do not exist, and, in a case where $Z^{51}$ is a nitrogen atom, $R^{60}$ does not exist.

$$-(\alpha)_l-(\beta)_m\gamma \quad (A)$$

In general formula (A), at least one of α, β, and γ is a group having a substituent group, and the substituent group is selected from the group consisting of a hydroxy group, a thiol group, an amino group, a carboxyl group, and a methoxy group. l and m each are independently one of 0 and 1, and the sum of l and m is 0 or more and 2 or less.

α represents one of an alkylene group having a main chain the number of atoms of which is 1 to 6, an alkylene group having a main chain which is substituted by an alkyl group with a carbon number of 1 to 6 and the number of atoms of which is 1 to 6, an alkylene group having a main chain which is substituted by a benzyl group and the number of atoms of which is 1 to 6, an alkylene group having a main chain which is substituted by an alkoxycarbonyl group and the number of atoms of which is 1 to 6, and an alkylene group having a main chain which is substituted by a phenyl group and the number of atoms of which is 1 to 6. These groups each can have at least one group selected from the group consisting of a hydroxy group, a thiol group, an amino group, a carboxyl group, and a methoxy group as a substituent group. One of $CH_2$ in the main chain of an alkylene group can be substituted by one of O, S, and $NR^{122}$ (in formula, $R^{122}$ representing a hydrogen atom or an alkyl group).

β represents one of a phenylene group, an alkyl-substituted phenylene group with a carbon number of 1 to 6, a nitro-substituted phenylene group, a halogen group-substituted phenylene group, and an alkoxy group-substituted phenylene group. These groups each can have at least one group selected from the group consisting of a hydroxy group, a thiol group, an amino group, a carboxyl group, and a methoxy group as a substituent group.

γ represents one of a hydrogen atom, an alkyl group having a main chain the number of atoms of which is 1 to 6, and an alkyl group having a main chain which is substituted by an alkyl group with a carbon number of 1 to 6 and the number of atoms of which is 1 to 6. These groups each can have at least one group selected from the group consisting of a hydroxy group, a thiol group, an amino group, a carboxyl group, and a methoxy group as a substituent group. One of $CH_2$ in the main chain of an alkyl group can be substituted by one of O, S, and $NR^{123}$ (in formula, $R^{123}$ representing a hydrogen atom or an alkyl group).

Among these, in particular, a compound represented by general formula (A1) or a compound represented by general formula (A8) is desirable. These compounds have a structure that facilitates stacking and are, therefore, deemed to be able to more effectively produce the effect of improving adhesiveness caused by inclusion of the above-mentioned particles. Furthermore, these compounds can be synthesized by the method discussed in Japanese Patent Application. Laid-Open. No. 2015-143828. Specific examples of the compounds represented by general formulae (A1) (A8) are shown as follows.

Specific Examples of Compounds Represented by General Formula (A1)

| | $R^{11}$~$R^{14}$ | $R^{15}$ | $R^{16}$ |
|---|---|---|---|
| A101 | H | 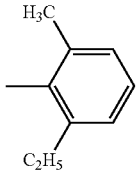 | 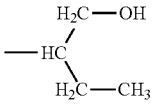 |

-continued
| | $R^{11}$~$R^{14}$ | $R^{15}$ | $R^{16}$ |
|---|---|---|---|
| A102 | H | 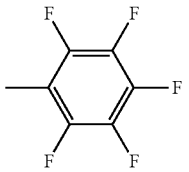 | 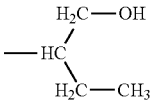 |
| A103 | H | 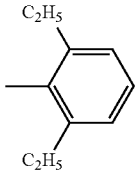 | 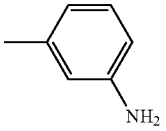 |
| A104 | H | 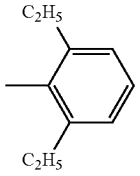 | 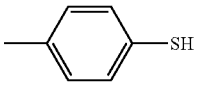 |
| A105 | H | 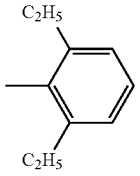 | 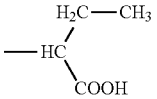 |
| A106 | H | 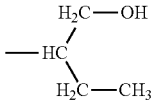 | 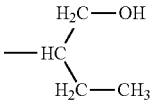 |
| A107 | H | 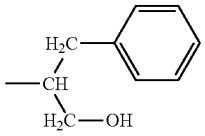 | 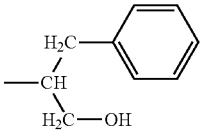 |
| A108 | H | 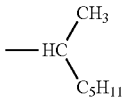 | 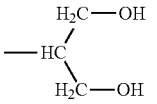 |
| A109 | H | 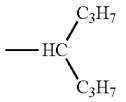 | 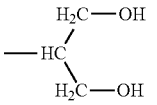 |
| A110 | H | 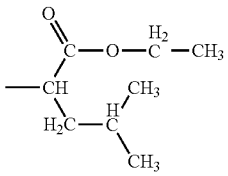 | 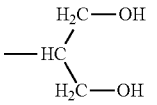 |

-continued
| | $R^{11}$~$R^{14}$ | $R^{15}$ | $R^{16}$ |
|---|---|---|---|
| A111 | H | 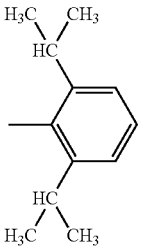 | 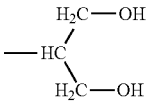 |
| A112 | H | 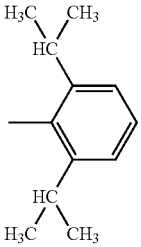 | 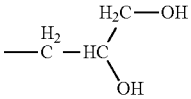 |
| A113 | H | 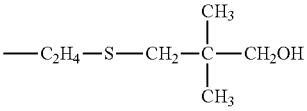 | 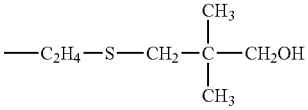 |
| A114 | H | 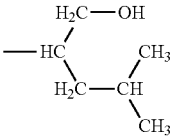 | 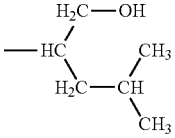 |
| A115 | H | 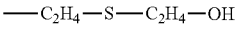 | 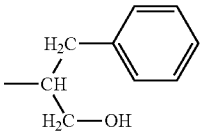 |
| A116 | H | 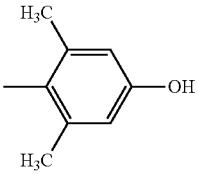 | 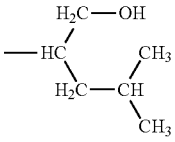 |
| A117 | H | 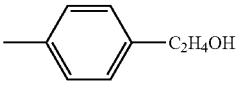 | 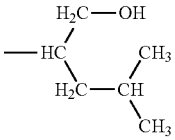 |
| A118 | H | 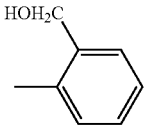 | 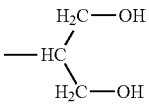 |
| A119 | H | 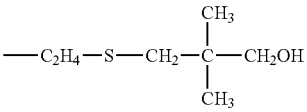 | 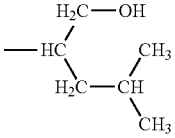 |

-continued

| | $R^{11}$~$R^{14}$ | $R^{15}$ | $R^{16}$ |
|---|---|---|---|
| A120 | H | 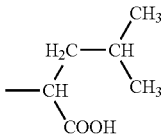 | 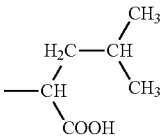 |

Specific Examples of Compounds Represented by General Formula (A8)

| | $R^{81}$ | $R^{82}$ | $R^{83}$~$R^{86}$ | $R^{87}$ | $R^{88}$ | $R^{89}$ | $R^{90}$ |
|---|---|---|---|---|---|---|---|
| A801 | H | H | H | H | H | 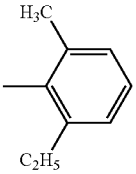 | 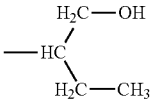 |
| A802 | H | H | H | H | H | 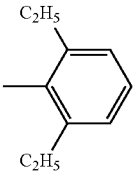 | 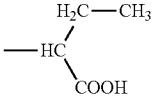 |
| A803 | H | CN | H | CN | H | 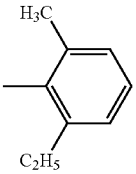 | 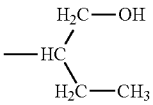 |
| A804 | H | H | H | H | H | 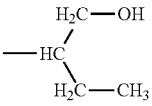 | 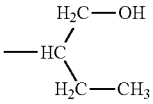 |
| A805 | H | H | H | H | H | 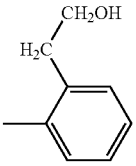 | 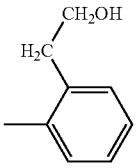 |

(2) Cross-Linking Agent

Any known material can be used as the cross-linking agent. Specific examples of the cross-linking agent include a compound described in "Cross-linking Agent Handbook." edited by Shinzo Yamashita and Tosuke Kaneko and published by TAISEISHA in 1981. In the present exemplary embodiment, it is desirable that the cross-linking agent have a polymerizable functional group.

In the present exemplary embodiment, it is desirable that the cross-linking agent be an isocyanate compound or an amino compound.

Examples of desirable cross-linking agents available in the market include:

SUPER MELAMI No. 90 (manufactured by NOF Corporation);

SUPER BECKAMINE® TD-139-60, L-105-60, L127-60, L110-60, J-820-60, G-821-60, L-148-55, 13-535, L-145-60, and TD-126 (all manufactured by DIC Corporation);

UBAN 2020 (manufactured by Mitsui Chemicals Inc.);

SUMITEX RESIN M-3 (manufactured by Sumitomo Chemical Co., Ltd.); and

NIKALAC MW-30, MW-390, MX-750LM, BL-60, BX-4000, MX-280, MX-270, and MX-290 (all manufactured by Nippon Carbide Industries Co., Inc.).

(3) Resin

In the present exemplary embodiment, the undercoat layer can contain a polymerized product of a composition including an electron transporting material, a cross-linking agent, and a resin. The weight-average molecular weight of the resin is desirably 5,000 or more and 400,000 or less.

It is desirable that the resin be a thermoplastic resin, and examples thereof include a polyacetal resin, a polyolefin resin, a polyester resin, a polyether resin, and a polyamide resin. Furthermore, it is desirable that the resin have a polymerizable functional group. Examples of the polymerizable functional group include a hydroxy group, a thiol group, an amino group, a carboxyl group, and a methoxy group. In other words, it is desirable that the resin have a structural unit represented by the following general formula:

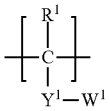

In the above general formula, $R^1$ represents one of a hydrogen atom and an alkyl group. $Y^1$ represents one of a single bond, an alkylene group, and a phenylene group. $W^1$ represents one of a hydroxy group, a thiol group, an amino group, a carboxyl group, and a methoxy group.

Examples of the thermoplastic resin having a polymerizable functional group available in the market include:

a polyether polyol based resin, such as AQD-457 and AQD-473 (all manufactured by Nippon Polyurethane Industry Co., Ltd.), and GP-400 and GP-700 (all manufactured by Sanyo Chemical Industries, Ltd., SANNIX GP series);

a polyester polyol based resin, such as PHTHALKID W2343 (manufactured by Hitachi Chemical Co., Ltd.), WATERSOL S-118, CD-520, BECKOLITE M-6402-50, M-6201-40IM (all manufactured by DIC Corporation), HARIDIP WH-1188 (manufactured by Harima Chemicals Group, Inc.), and ES3604 and ES6538 (manufactured by Japan Upica Co., Ltd.);

a polyacryl polyol based resin, such as BURNOCK WE-300 and WE-304 (all manufactured by DIC Corporation);

a polyvinyl alcohol based resin such as KURARAY POVAL PVA-203 (manufactured by Kuraray Co., Ltd.);

a polyvinyl acetal based resin, such as BX-1, BM-1, and KS-5 (all manufactured by Sekisui Chemical Co., Ltd.);

a polyamide based resin such as TORESIN FS-350 (manufactured by Nagase ChemteX Corporation);

a carboxyl group-containing resin, such as AQUALIC (manufactured by Nippon Shokubai Co., Ltd.) and FINELEX SG2000 (manufactured by Namariichi Co., Ltd.);

a polyamine resin such as RACKAMIDE (manufactured by DIC Corporation); and a polythiol resin such as QE-340M (manufactured by Toray Industries, Inc). Among these, for example, a polyvinyl acetal resin having a polymerizable functional group and a polyester polyol based resin having a polymerizable functional group are desirable from the viewpoint of polymerizing property and the homogeneity of the undercoat layer.

<Photosensitive Layer>

The electrophotographic photosensitive member in the present exemplary embodiment includes a photosensitive layer adjacent to the undercoat layer. The photosensitive layer of the electrophotographic photosensitive member is mainly classified into a multilayer photosensitive layer (1) and a single-layer photosensitive layer (2). The multilayer photosensitive layer (1) includes a charge generating layer containing a charge generating material, and a charge transport layer containing a charge transporting material. The single-layer photosensitive layer (2) includes a photosensitive layer containing both a charge generating material and a charge transporting material.

In the present exemplary embodiment, the average film thickness of the entire photosensitive layer s desirably 25 μm or less. This is because the pressure relaxation effect caused by the undercoat layer functions in a particularly efficient manner. Furthermore, the average film thickness of the entire photosensitive layer s desirably 5 μm or more. Moreover, in particular, the average film thickness of the whole photosensitive layer is desirably 25 μm or less and the average film thickness of the undercoat layer is desirably 1/40 or more and 1/10 or less of the average film thickness of the entire cylindrical structure.

(1) Multilayer Photosensitive Layer

The multilayer photosensitive layer includes a charge generating layer and a charge transport layer.

(1-1) Charge Generating Layer

The average film thickness of the charge generating layer is desirably in the range of 0.05 μm to 5 μm.

Examples of the charge generating material include azo pigments, perylene pigments, anthraquinone derivatives, anthanthrone derivatives, dibenzpyrenequinone derivatives, pyranthrone derivatives, violanthrone derivatives, isoviolanthrone derivatives, indigo derivatives, thioindigo derivatives, phthalocyanine pigments, and bisbenzimidazole derivatives. Among these, it is desirable that the charge generating layer contain at least one charge generating material selected from the group of consisting of phthalocyanine pigments and azo pigments.

Desirable phthalocyanine pigments include oxytitanium pthalocyanine, chlorogallium phthalocyanine, and hydroxygallium phthalocyanine.

As oxytitanium phthalocyanine, an oxytitanium phthalocyanine crystal of the crystalline form having strong peaks at 9.0°, 14.2°, 23.9°, and 27.1° in Bragg angle (2θ±0.2° by CuKα characteristic X-ray diffraction and an oxytitanium phthalocyanine crystal of the crystalline form having strong peaks at 9.5°, 9.7°, 11.7°, 15.0°, 23.5°, 24.1°, and 27.3° in Bragg angle (2θ±0.2°) are desirable.

As chlorogallium phthalocyanine, a chlorogallium phthalocyanine crystal of the crystalline form having strong peaks at 7.4°, 16.6°, 25.5°, and 28.2° in Bragg angle (2θ±0.2° by CuKα characteristic X-ray diffraction, a chlorogallium phthalocyanine crystal of the crystalline form having strong peaks at 6.8°, 17.3°, 23.6°, and 26.9° in Bragg angle (2θ±0.2°), and a chlorogallium phthalocyanine crystal of the crystalline form having strong peaks at 8.7°, 9.2°, 17.6°, 24.0°, 27.4°, and 28.8° in Bragg angle (2θ±0.2°) are desirable.

As hydroxygallium phthalocyanine, a hydroxygallium phthalocyanine crystal of the crystalline form having strong peaks at 7.3°, 24.9°, and 28.1° in Bragg angle (2θ±0.2°) by CuKα characteristic X-ray diffraction and a hydroxygallium phthalocyanine crystal of the crystalline form having strong peaks at 7.5° 9.9°, 12.5°, 16.3°, 18.6° 25.1°, and 28.3° in Bragg angle (2θ±0.2°) are desirable.

Examples of a binder resin used in the charge generating layer include polymers or copolymers of vinyl compounds, such as styrene, vinyl acetate, vinyl chloride, acrylic acid esters, methacrylic acid esters, vinylidene fluoride, and trifluoroethylene; and polyvinyl alcohol resin, polyvinyl acetal resin, polycarbonate resin, polyester resin, polysulfone resin, polyphenylene oxide resin, polyurethane resin, cellulose resin, phenol resin, melamine resin, silicon resin, and epoxy resin. Among these, polyester resin, polycarbonate resin, and polyvinyl acetal resin are desirable, and polyvinyl acetal resin is more desirable. In the polyvinyl acetal resin, butyral resin is particularly desirable.

Furthermore, for example, various sensitizers, antioxidants, ultraviolet absorbers, or plasticizer can be added to the charge generating layer as appropriate. Moreover, to prevent the flow of charges from stagnating in the charge generating layer, an electron transporting (an electron-accepting material such as an acceptor) can be contained in the charge generating layer.

The charge generating material content in the charge generating layer is desirably in the range of 30% by mass to 90% by mass, or more desirably in the range of 50% mass to 80% mass, relative to the total mass of the charge generating layer.

In the charge generating layer, the mass ratio of the charge generating material to the binder resin (mass of the charge generating material/mass of the binder resin) is desirably in the range of 5/1 to 1/5, or more desirably in the range of 3/1 to 1/1.

The charge generating layer can be formed by applying a coating liquid for the charge generating layer prepared by mixing a charge generating material and a binder resin with a solvent, and drying the coating. Examples of the solvent used in the coating liquid for the charge generating layer include an alcohol-based solvent, a sulfoxide-based solvent, a ketone-based solvent, an ether-based solvent, an ester-based solvent, and an aromatic hydrocarbon solvent.

(1-2) Charge Transport Layer

The film thickness of the charge transport layer is desirably in the range of 3 μm to 40 μm, or more desirably in the range of 5 μm to 25 μm.

Examples of the charge transporting material in the charge transport layer include polycyclic aromatic compounds, heterocyclic compounds, hydrazone compounds, styryl compounds, enamine compounds, benzidine compounds, triarylamine compounds, and triphenylamine. Furthermore, the charge transporting material can be a polymer having a group derived from these compounds in the main chain or a side chain. Among these, triarylamine compounds and benzidine compounds are desirable in terms of potential stability during repeated use.

Examples of the binder resin used in the charge transport layer include polyester, acrylic resin, phenoxy resin, polycarbonate, polystyrene, polyvinyl acetate, polysulfone, polyarylate, vinylidene chloride, and acrylonitrile copolymer. Among these, polycarbonate and polyarylate are desirable. The weight-average molecular weight of the binder resin is desirably 10,000 or more and 300,000 or less.

An antioxidant, an ultraviolet absorber, or a plasticizer can be added to the charge transport layer as appropriate.

The charge transporting material content in the charge transport layer is desirably in the range of 20% mass to 80% by mass, or more desirably in the range of 30% mass to 60% by mass, relative to the total mass of the charge transport layer.

In the charge transport layer, the mass ratio of the charge transporting material to the binder resin (mass of the charge transporting material/mass of the binder resin) is desirably in the range of 10/5 to 5/10, or more desirably in the range of 10/8 to 6/10.

The charge transport layer can be formed by applying a coating liquid for the charge transport layer prepared by dissolving a charge transporting material and a binder resin in a solvent, and drying the coating. Examples of the solvent used in the coating liquid for forming the charge transport layer include an alcohol-based solvent, a sulfoxide-based solvent, a ketone-based solvent, an ether-based solvent, an ester-based solvent, and an aromatic hydrocarbon solvent.

<Protective Layer>

In the present embodiment, a protective layer can be provided on the photosensitive layer. It is desirable that the protective layer contain electrically conductive particles or a charge transporting material and a binder resin. The protective layer can further contain an additive, such as a lubricant. The binder resin in the protective layer can have electrical conductivity or charge transporting ability. Furthermore, in this instance, electrically conductive particles or a charge transporting material does not need to be added to the protective layer. Moreover, the binder resin in the protective layer can be a thermoplastic resin, or can be a resin cured by heat, light, or radiation (e.g., electron beam).

(2) Single-Layer Photosensitive Layer

The single-layer photosensitive layer can be formed by applying a coating liquid for the photosensitive layer prepared by dissolving the charge generating material, the charge transporting material, and a binder resin in a solvent, and drying the coating. The charge transporting material and the binder resin can be selected from among the same materials cited in "(1) Multilayer Photosensitive Layer".

[Process Cartridge and Electrophotographic Apparatus]

The process cartridge according to the present exemplary embodiment includes and integrally supports the above-described electrophotographic photosensitive member and at least one device selected from the group consisting of a charging device, a developing device, a transfer device, and a cleaning device, and is detachably attachable to an electrophotographic apparatus.

Furthermore, the electrophotographic apparatus according to the present exemplary embodiment includes the above-described electrophotographic photosensitive member, a charging device, an exposure device, a developing device, and a transfer device.

FIG. 1 illustrates an example of a schematic configuration of an electrophotographic apparatus provided with a process cartridge including an electrophotographic photosensitive member.

The electrophotographic photosensitive member 1 in a cylindrical shape (drum shape) is driven for rotation around an axis 2 in the direction indicated by an arrow at a predetermined peripheral speed (process speed). The surface of the electrophotographic photosensitive member 1 driven for rotation is charged to a predetermined positive or negative potential by a charging device 3 during the process of rotation. Then, the surface of the charged electrophotographic photosensitive member 1 is irradiated with exposure light from an exposure device (not illustrated), and electrostatic latent images corresponding to intended image information are sequentially formed one after another on the surface of the electrophotographic photosensitive member 1. The exposure light 4 is light output from an image exposure device, such as a slit exposure or laser beam scanning exposure device, and intensity-modulated according to a time series electrical digital image signal corresponding to intended image information.

The electrostatic latent images formed on the surface of the electrophotographic photosensitive member 1 are then developed (normally developed or inversely developed) with the toner contained in the developing device 5, thus forming toner images on the surface of the electrophotographic photosensitive member 1. The toner images formed on the surface of the electrophotographic photosensitive member 1 are transferred by a transfer device 6 to a transfer medium 7 one after another. At this time, a bias voltage, which is opposite in polarity to the retained charge of the toner, is applied from a bias power source (not illustrated) to the transfer device 6. Furthermore, in a case where the transfer medium 7 is paper, the transfer medium 7 is extracted from a paper feed unit (not illustrated) and is then fed to a portion between the electrophotographic photosensitive member 1 and the transfer device 6 in synchronization with the rotation of the electrophotographic photosensitive member 1.

The transfer medium 7 to which the toner images have been transferred from, the electrophotographic photosensitive member 1 is separated from the surface of the electrophotographic photosensitive member 1 and is then conveyed to a fixing device 8, in which the toner images are fixed, thus being ejected as an image-formed article (printed material or copy) to the outside of the apparatus.

The surface of the electrophotographic photosensitive member 1, from which the toner images have been transferred to the transfer medium 7, is cleaned with a cleaning device 9 to remove the attached matter such as toner (toner remaining after transfer) from the surface of the electrophotographic photosensitive member 1. Since, in recent years, a cleanerless system has been developed, the toner remaining after transfer can be directly removed by, for example, a developing device. Furthermore, the surface of the electrophotographic photosensitive member 1 is subjected to removal of static electricity by pre-exposure light 10 from a pre-exposure device (not illustrated) before being reused to form images. If the charging device 3 is of the contact charging type using, for example, a charging roller, however, the pre-exposure device is not necessarily required.

In the present exemplary embodiment, some of the components including the electrophotographic photosensitive member 1, the charging device 3, the developing device 5, the transfer device 6, and the cleaning device 9 can be integrally combined in a single container serving as a process cartridge. Then, the process cartridge can be configured to be detachably attachable to an electrophotographic apparatus. For example, at least one selected from the group consisting of the charging device 3, the developing device 5, and the cleaning device 9 and the electrophotographic photosensitive member 1 are integrally supported and combined into a cartridge. Then, the cartridge is guided by a guide 12 such as a rail of the electrophotographic apparatus body, thus being used as a process cartridge 11 that is detachably attachable to the electrophotographic apparatus.

In a case where the electrophotographic apparatus is a copying machine or a printer, the exposure light 4 can be reflected light or transmitted light from an original. Alternatively, the exposure light 4 can be ht emitted by, for example, scanning of a laser beam, driving of a light-emitting diode (LED) array, or driving of a liquid crystal shutter array, which is performed according to a signal obtained by reading an original with a sensor.

The electrophotographic photosensitive member 1 in the present exemplary embodiment, can be widely adapted to various electrophotographic fields, such as a laser beam printer, a cathode-ray tube (CRT) printer, an LED printer, a facsimile (FAX), a liquid crystal printer, and laser plate making.

EXAMPLES

The subject matter of the present exemplary embodiment as further described in detail with reference to Examples and Comparative Examples. The subject matter is however not limited to the following Examples unless exceeding the gist thereof. In the following Examples, "part(s)" is on a mass basis unless otherwise specified.

Preparation of Electrophotographic Photosensitive Member

Example 1

An aluminum cylinder (JIS-A3003, aluminum alloy) of 30 mm in diameter subjected to honing processing and ultrasonic aqueous cleaning was used as a support member (electrically conductive support member).

Then, 4 parts of an electron transporting material (A101), 5.5 parts of a cross-linking agent B1 (H1) (B1:H1=5.1:2.2 (mass ratio)), 0.3 parts of a resin (D1), and 0.05 parts of dioctyl tin laurate serving as a catalyst were dissolved in a mixed solvent of 50 parts of dimethylacetamide and 50 parts of methyl ethyl ketone. Then, 2.0 parts of acrylic rubber particles (product name: METABLEN W-450A, manufactured by Mitsubishi Rayon, average particle size: 0.2 μm) was added to the solution, which was then stirred to yield an undercoat layer coating fluid. This undercoat layer coating liquid was applied to the support member by dipping, and the resulting coating film was heated at 160° C. for 40 minutes and polymerized to form an undercoat layer with a film thickness of 1.0 μm.

The content of the electron transporting material in the undercoat layer was 41% by mass relative to the total mass of the composition. Moreover, the content of the particles in the undercoat layer was 50% by mass relative to the content of the electron transporting material.

Then, 10 parts of a hydroxygallium phthalocyanine crystal (charge generating material)

(having the crystalline form having strong peaks at 7.5°, 9.9°, 12.5°, 16.3°, 18.6°, 25.1°, and 28.3° in Bragg angle (2θ±0.2°) by CuKα characteristic X-ray diffraction), 0.1 parts of a compound represented by the following formula:

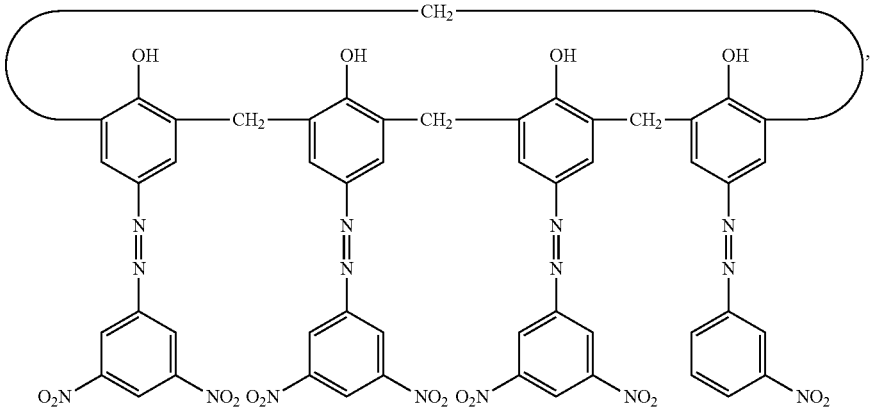

5 parts of polyvinyl butyral (product name: S-LEC BX-1, manufactured by Sekisui Chemical Co., Ltd.), and 250 parts of cyclohexanone, were put into a sand mill containing glass beads of 0.8 mm in diameter, and were dispersed in each other for 1.5 hours. Then, 250 parts of ethyl acetate was added to the dispersion liquid to yield a charge generating layer coating liquid.

The charge generating layer coating liquid was applied onto the undercoat layer by dipping, and the resulting coating film was dried at 100° C. for 10 minutes to form a charge generating layer with a film thickness of 0.15 μm.

Then, 4 parts of a triarylamine compound represented by the following formula:

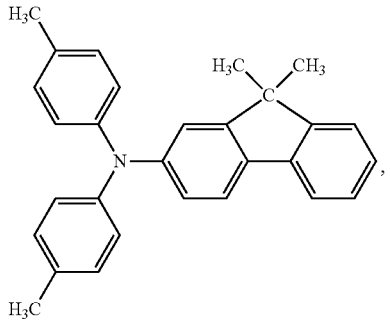

4 parts of a benzidine compound represented by the following formula:

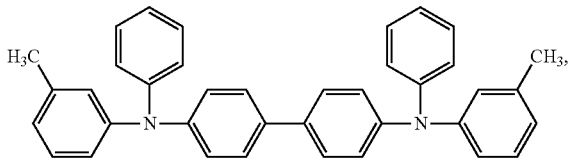

10 parts of polycarbonate of the bisphenol Z type (product name: 2400, manufactured by Mitsubishi Engineering-Plastics Corporation), were dissolved in a mixed solvent of 40 parts of dimethoxymethan and 60 parts of chlorobenzene to yield a charge transport layer coating liquid. The charge transport layer coating liquid was applied onto the charge generating layer by dipping, and the resulting coating film was dried at 120° C. for 40 minutes to yield a charge transport layer with film thickness of 20 μm, so that electrophotographic photosensitive member was produced.

Examples 2 to 38 and Comparative Examples 1 to 6

Electrophotographic photosensitive members were produced in the same manner as in Example 1, except that the material types and their usages (parts) in the undercoat layer coating fluid, the film thickness of the undercoat layer, and the film thickness of the charge transport layer were replaced as shown in Table 1 and Table 2. Furthermore, details of the material types in the tables are described below.

Example 39

An electrophotographic photosensitive member was produced in the same manner as in Example 1, except that the charge generating layer was formed in the following way.

10 parts of oxytitanium phthalocyanine (TiPC), which is described below, and a polyvinyl butyral resin (product name: S-LEC BX-1, manufactured by Sekisui Chemical Co., Ltd.) were dissolved in a mixed solvent of cyclohexanone and water (=97:3), and 166 parts of the resultant 5% by mass solution was prepared. The resolution and 150 parts of a mixed solvent of cyclohexanone and water (=97:3) as well as 400 parts of glass beads of 1 mm in diameter were put into a sand mill device and were dispersed for 4 hours. After that, 210 parts of a mixed solvent of cyclohexanone and water (=97:3) and 260 parts of cyclohexanone were added to the dispersed solution to yield a charge generating layer coating fluid. The charge generating layer coating liquid was applied onto the undercoat layer by dipping, and the resulting coating film was dried at 80° C. for 10 minutes to form a charge generating layer.

Example 40

An electrophotographic photosensitive member was produced in the same manner as in Example 1, except that the charge generating layer was formed in the following way.

20 parts of a bisazo pigment, which is described below, and 10 parts of polyvinyl butyral resin (product name: S-LEC EX-1, manufactured by Sekisui Chemical Co., Ltd.) as well as 150 parts of tetrahydrofuran were mixed and dispersed to yield a charge generating layer coating fluid. The charge generating layer coating liquid was applied onto the undercoat layer by dipping, and the resulting coating film was dried at 110° C. for 30 minutes to form a charge generating layer.

Comparative Example 7

An electrophotographic photosensitive member was produced in the same manner as in Example 1, except that the undercoat layer was formed in the following way.

6 parts of an electron transporting material (A101), 2.1 parts of an amine compound (C1-3), 0.5 parts of a resin (D1), and 0.1 parts of a dodecylbenzenesulfonic acid serving as a catalyst were dissolved in a mixed solvent of 100 parts of dimethylacetamide and 100 parts of methyl ethyl ketone. Then, 2.0 parts of silicone resin particles (product name: TOSPEARL 120, manufactured by Momentive Performance Materials) was added to the solution, which was then stirred to yield an undercoat layer coating fluid. This undercoat layer coating liquid was applied to the support member by dipping, and the resulting coating film was heated at 160° C. for 40 minutes and polymerized to form an undercoat layer.

Comparative Example 8

An electrophotographic photosensitive member was produced in the same manner as in Example 1, except that the undercoat layer was formed in the following way.

100 parts by mass of zinc oxide (manufactured by Tayca Corporation, specific surface area value: 15 $m^2/g$) and 500 part by mass of tetrahydrofuran were stirred and mixed together, and 1.25 parts by mass of a silane coupling agent (product name: KBM603, manufactured by Shin-Etsu Chemical Co., Ltd.) was added to the mixture, which was then stirred for 2 hours. After that, toluene was distilled away distillation under reduced pressure, and quenching was performed at 120° C. for 3 hours, so that a zinc oxide pigment surface-treated with the silane coupling agent was yielded. 6 parts of the surface-treated zinc oxide pigment, 2 parts of an isocyanate compound (B1:protective group (H1)

=5.1:2.2 (mass ratio)), and 1.5 parts of a resin (D1) were dissolved and mixed in a mixed solvent of 50 parts of dimethylacetamide and 50 parts of methyl ethyl ketone. Then, the resulting solution was dispersed by a sand using glass beads of 1 mm in diameter for 2 hours. 0.3 parts of dioctyl tin laurate serving as a catalyst was added to the resulting dispersed liquid, which was then stirred to yield an undercoat layer coating fluid. This undercoat layer coating liquid was applied to the support member by dipping, and the resulting coating film was dried at 120° C. for 40 minutes to form an undercoat layer.

Comparative Example 9

An electrophotographic photosensitive member was produced in the same manner as in Example 1, except that the undercoat layer was formed in the following way.

6 parts of titanium oxide (product name: PT-101, manufactured by Ishihara Sangyo Kaisha, Ltd., average particle size: 70 nm), 2 parts of an alkyd resin (product name: BECKOLITE M6401-50, manufactured by DIC Corporation, solid content: 50%), and 1.5 parts of a melamine resin (product name: SUPER BECKAMINE G-821-60, manufactured by DIC Corporation, solid content: 60%) were dissolved in a mixed solvent of 50 parts of dimethylacetamide and 50 parts of methyl ethyl ketone. Then, 1 part of styrene/acrylic copolymer resin particles having a hollow structure (product name: SX866A, manufactured by JSR) was added to the solution, and the resulting solution was dispersed by a sand mill using glass beads of 1 mm in diameter for 2 hours to yield an undercoat layer coating fluid. This undercoat layer coating liquid was applied to the support member by dipping, and the resulting coating film was dried at 120° C. for 40 minutes to form an undercoat layer.

TABLE 1

Preparation Conditions of Electrophotographic Photosensitive Members

| | Undercoat Layer Undercoat Layer Coating Liquid | | | | | | | |
|---|---|---|---|---|---|---|---|---|
| | | | Composition | | | | | |
| | Particles | | Electron Transporting Material | | Cross-linking Agent | | Resin | |
| Example No. | Type | Usage (parts) | Type | Usage (parts) | Type | Usage (parts) | Type | Usage (parts) |
| Example 1 | METABLEN W-450A | 2.0 | A101 | 4.0 | B1:H1 | 5.5 | D1 | 0.3 |
| Example 2 | METABLEN W-450A | 0.4 | A101 | 4.0 | B1:H1 | 5.5 | D1 | 0.3 |
| Example 3 | METABLEN W-450A | 0.8 | A101 | 4.0 | B1:H1 | 5.5 | D1 | 0.3 |
| Example 4 | METABLEN W-450A | 1.2 | A101 | 4.0 | B1:H1 | 5.5 | D1 | 0.3 |
| Example 5 | METABLEN W-450A | 1.6 | A101 | 4.0 | B1:H1 | 5.5 | D1 | 0.3 |
| Example 6 | METABLEN W-450A | 2.4 | A101 | 4.0 | B1:H1 | 5.5 | D1 | 0.3 |
| Example 7 | METABLEN W-450A | 3.2 | A101 | 4.0 | B1:H1 | 5.5 | D1 | 0.3 |
| Example 8 | METABLEN W-450A | 4.0 | A101 | 4.0 | B1:H1 | 5.5 | D1 | 0.3 |
| Example 9 | METABLEN S-2001 | 2.0 | A101 | 4.0 | B1:H1 | 5.5 | D1 | 0.3 |
| Example 10 | METABLEN E-901 | 2.0 | A101 | 4.0 | B1:H1 | 5.5 | D1 | 0.3 |
| Example 11 | METABLEN W300A | 2.0 | A101 | 4.0 | B1:H1 | 5.5 | D1 | 0.3 |
| Example 12 | Kane Ace FM | 2.0 | A101 | 4.0 | B1:H1 | 5.5 | D1 | 0.3 |
| Example 13 | Kane Ace B | 2.0 | A101 | 4.0 | B1:H1 | 5.5 | D1 | 0.3 |
| Example 14 | XSK-500 | 2.0 | A101 | 4.0 | B1:H1 | 5.5 | D1 | 0.3 |
| Example 15 | XER-91 | 2.0 | A101 | 4.0 | B1:H1 | 5.5 | D1 | 0.3 |
| Example 16 | SX866A | 2.0 | A101 | 4.0 | B1:H1 | 5.5 | D1 | 0.3 |
| Example 17 | ROPAQUE HP-1055 | 2.0 | A101 | 4.0 | B1:H1 | 5.5 | D1 | 0.3 |
| Example 18 | METABLEN W-450A | 2.0 | A101 | 4.0 | B1:H1 | 7.3 | D1 | 0.9 |
| Example 19 | METABLEN W-450A | 2.0 | A101 | 5.0 | C1-3 | 2.3 | D1 | 3.3 |
| Example 20 | METABLEN W-450A | 2.0 | A101 | 5.0 | C1-3 | 1.7 | D1 | 1.9 |
| Example 21 | METABLEN W-450A | 2.0 | A101 | 6.0 | C1-3 | 2.1 | D1 | 0.5 |

TABLE 1-continued

| Preparation Conditions of Electrophotographic Photosensitive Members | | | | | | | | |
|---|---|---|---|---|---|---|---|---|
| Example 22 | METABLEN W-450A | 2.0 | A101 | 4.0 | B1:H1 | 5.5 | D1 | 0.3 |
| Example 23 | METABLEN W-450A | 2.0 | A101 | 4.0 | B1:H1 | 5.5 | D1 | 0.3 |
| Example 24 | METABLEN W-450A | 2.0 | A101 | 4.0 | B1:H1 | 5.5 | D1 | 0.3 |
| Example 25 | METABLEN W-450A | 2.0 | A101 | 4.0 | B1:H1 | 5.5 | D1 | 0.3 |

| | Undercoat Layer | | | |
|---|---|---|---|---|
| | Undercoat Layer Coating Liquid | | | |
| Example No. | Composition Electron Transporting Material/ Composition (% by mass) | Particles/ Electron Transporting Material (% by mass) | Film Thickness of Undercoat Layer (μm) | Number Average Particle Size of Particles/ Film Thickness of Undercoat Layer |
| Example 1 | 41 | 50 | 1.00 | 0.20 |
| Example 2 | 41 | 10 | 1.00 | 0.20 |
| Example 3 | 41 | 20 | 1.00 | 0.20 |
| Example 4 | 41 | 30 | 1.00 | 0.20 |
| Example 5 | 41 | 40 | 1.00 | 0.20 |
| Example 6 | 41 | 60 | 1.00 | 0.20 |
| Example 7 | 41 | 80 | 1.00 | 0.20 |
| Example 8 | 41 | 100 | 1.00 | 0.20 |
| Example 9 | 41 | 50 | 1.00 | 0.20 |
| Example 10 | 41 | 50 | 1.00 | 0.20 |
| Example 11 | 41 | 50 | 1.00 | 0.10 |
| Example 12 | 41 | 50 | 1.00 | 0.20 |
| Example 13 | 41 | 50 | 1.00 | 0.20 |
| Example 14 | 41 | 50 | 1.00 | 0.50 |
| Example 15 | 41 | 50 | 1.00 | 0.50 |
| Example 16 | 41 | 50 | 1.00 | 0.30 |
| Example 17 | 41 | 50 | 1.50 | 0.67 |
| Example 18 | 33 | 50 | 1.00 | 0.20 |
| Example 19 | 47 | 40 | 1.00 | 0.20 |
| Example 20 | 58 | 40 | 1.00 | 0.20 |
| Example 21 | 70 | 33 | 1.00 | 0.20 |
| Example 22 | 41 | 50 | 0.75 | 0.27 |
| Example 23 | 41 | 50 | 0.48 | 0.42 |
| Example 24 | 41 | 50 | 1.20 | 0.17 |
| Example 25 | 41 | 50 | 1.50 | 0.13 |

| | Photosensitive Layer | | | |
|---|---|---|---|---|
| | Charge Generating Layer | | Charge Transport Layer | Film Thickness |
| Example No. | Type of Charge Generating Material | Film Thickness (μm) | Film Thickness (μm) | of Undercoat Layer/ Film Thickness of Photosensitive Layer |
| Example 1 | GaPC | 0.15 | 20.00 | 0.05 |
| Example 2 | GaPC | 0.15 | 20.00 | 0.05 |
| Example 3 | GaPC | 0.15 | 20.00 | 0.05 |
| Example 4 | GaPC | 0.15 | 20.00 | 0.05 |
| Example 5 | GaPC | 0.15 | 20.00 | 0.05 |
| Example 6 | GaPC | 0.15 | 20.00 | 0.05 |

TABLE 1-continued

| Preparation Conditions of Electrophotographic Photosensitive Members | | | | |
|---|---|---|---|---|
| Example 7 | GaPC | 0.15 | 20.00 | 0.05 |
| Example 8 | GaPC | 0.15 | 20.00 | 0.05 |
| Example 9 | GaPC | 0.15 | 20.00 | 0.05 |
| Example 10 | GaPC | 0.15 | 20.00 | 0.05 |
| Example 11 | GaPC | 0.15 | 20.00 | 0.05 |
| Example 12 | GaPC | 0.15 | 20.00 | 0.05 |
| Example 13 | GaPC | 0.15 | 20.00 | 0.05 |
| Example 14 | GaPC | 0.15 | 20.00 | 0.05 |
| Example 15 | GaPC | 0.15 | 20.00 | 0.05 |
| Example 16 | GaPC | 0.15 | 20.00 | 0.05 |
| Example 17 | GaPC | 0.15 | 20.00 | 0.07 |
| Example 18 | GaPC | 0.15 | 20.00 | 0.05 |
| Example 19 | GaPC | 0.15 | 20.00 | 0.05 |
| Example 20 | GaPC | 0.15 | 20.00 | 0.05 |
| Example 21 | GaPC | 0.15 | 20.00 | 0.05 |
| Example 22 | GaPC | 0.15 | 20.00 | 0.04 |
| Example 23 | GaPC | 0.15 | 20.00 | 0.02 |
| Example 24 | GaPC | 0.15 | 20.00 | 0.06 |
| Example 25 | GaPC | 0.15 | 20.00 | 0.07 |

TABLE 2

| Preparation Conditions of Electrophotographic Photosensitive Members | | | | | | | | |
|---|---|---|---|---|---|---|---|---|
| | Undercoat Layer Undercoat Layer Coating Liquid | | | | | | | |
| | | | Composition | | | | | |
| | Particles | | Electron Transporting Material | | Cross-linking Agent | | Resin | |
| Example No. | Type | Usage (parts) | Type | Usage (parts) | Type | Usage (parts) | Type | Usage (parts) |
| Example 26 | METABLEN W-300A | 2.0 | A101 | 4.0 | B1:H1 | 5.5 | D1 | 0.3 |
| Example 27 | METABLEN W-450A | 2.0 | A118 | 4.0 | B1:H2 | 5.5 | D2 | 0.3 |
| Example 28 | METABLEN W-450A | 2.0 | A201 | 4.0 | B1:H3 | 5.5 | D3 | 0.3 |
| Example 29 | METABLEN W-450A | 2.0 | A305 | 4.0 | B4:H1 | 5.5 | D4 | 0.3 |
| Example 30 | METABLEN W-450A | 2.0 | A404 | 4.0 | B5:H1 | 5.5 | D5 | 0.3 |
| Example 31 | METABLEN W-450A | 2.0 | A501 | 4.0 | B7:H1 | 5.5 | D1 | 0.3 |
| Example 32 | METABLEN W-450A | 2.0 | A602 | 4.0 | B12:H1 | 5.5 | D1 | 0.3 |
| Example 33 | METABLEN W-450A | 2.0 | A704 | 5.0 | C1-1 | 2.3 | D1 | 3.3 |
| Example 34 | METABLEN W-450A | 2.0 | A804 | 5.0 | C1-9 | 2.3 | D1 | 3.3 |
| Example 35 | METABLEN W-450A | 2.0 | A902 | 5.0 | C2-1 | 2.3 | D1 | 3.3 |

TABLE 2-continued

| Preparation Conditions of Electrophotographic Photosensitive Members | | | | | | | | |
|---|---|---|---|---|---|---|---|---|
| Example 36 | METABLEN W-450A | 2.0 | A1001 | 5.0 | C3-3 | 2.3 | D6 | 3.3 |
| Example 37 | METABLEN W-450A B | 2.0 | A101 | 4.0 | B1:H1 | 5.5 | D1 | 0.3 |
| Example 38 | METABLEN W-450A | 2.0 | A101 | 4.0 | B1:H1 | 5.5 | D1 | 0.3 |
| Example 39 | METABLEN W-450A | 2.0 | A101 | 4.0 | B1:H1 | 5.5 | D1 | 0.3 |
| Example 40 | METABLEN W-450A | 2.0 | A101 | 4.0 | B1:H1 | 5.5 | D1 | 0.3 |
| Comparative Example 1 | — | 0 | A101 | 5.0 | C1-3 | 2.3 | D1 | 3.3 |
| Comparative Example 2 | METABLEN W-450A | 0.3 | A101 | 5.0 | C1-3 | 2.3 | D1 | 3.3 |
| Comparative Example 3 | METABLEN W-450A | 6.0 | A101 | 5.0 | C1-3 | 2.3 | D1 | 3.3 |
| Comparative Example 4 | — | 0 | A101 | 2.0 | C1-3 | 2.3 | D1 | 3.3 |
| Comparative Example 5 | METABLEN W-450A | 1.2 | A101 | 2.0 | C1-3 | 2.3 | D1 | 3.3 |
| Comparative Example 6 | TAFTIC FH-S | 2.0 | A101 | 3.0 | B1:H1 | 5.5 | D1 | 0.3 |
| Comparative Example 7 | TOSPEARL 120 | 2.0 | A101 | 6.0 | C1-3 | 2.1 | D1 | 0.5 |
| Comparative Example 8 | Zinc Oxide | 6.0 | — | 0 | B1:H1 | 2.0 | D1 | 1.5 |
| Comparative Example 9 | SX866A | 1.0 | — | 0 | Melamine/Alkyd Resin | | | 2.0/1.5 |

| | Undercoat Layer | | | |
|---|---|---|---|---|
| | Undercoat Layer Coating Liquid | | | Number |
| Example No. | Composition Electron Transporting Material/ Composition (% by mass) | Particles/ Electron Transporting Material (% by mass) | Film Thickness of Undercoat Layer (μm) | Average Particle Size of Particles/ Film Thickness of Undercoat Layer |
| Example 26 | 41 | 50 | 1.20 | 0.08 |
| Example 27 | 41 | 50 | 1.00 | 0.20 |
| Example 28 | 41 | 50 | 1.00 | 0.20 |
| Example 29 | 41 | 50 | 1.00 | 0.20 |
| Example 30 | 41 | 50 | 1.00 | 0.20 |
| Example 31 | 41 | 50 | 1.00 | 0.20 |
| Example 32 | 41 | 50 | 1.00 | 0.20 |
| Example 33 | 47 | 40 | 1.00 | 0.20 |
| Example 34 | 47 | 40 | 1.00 | 0.20 |
| Example 35 | 47 | 40 | 1.00 | 0.20 |
| Example 36 | 47 | 40 | 1.00 | 0.20 |
| Example 37 | 41 | 50 | 1.00 | 0.20 |
| Example 38 | 41 | 50 | 1.00 | 0.20 |
| Example 39 | 41 | 50 | 1.00 | 0.20 |
| Example 40 | 41 | 50 | 1.00 | 0.20 |
| Comparative Example 1 | 47 | — | 1.00 | — |
| Comparative Example 2 | 47 | 6 | 1.00 | 0.20 |
| Comparative Example 3 | 47 | 120 | 1.00 | 0.20 |
| Comparative Example 4 | 26 | — | 1.00 | — |
| Comparative Example 5 | 26 | 60 | 1.00 | 0.20 |
| Comparative Example 6 | 34 | 67 | 1.00 | 0.50 |
| Comparative Example 7 | 70 | 33 | 3.00 | 0.67 |
| Comparative Example 8 | — | — | 5.00 | 0.01 |
| Comparative Example 9 | — | — | 10.00 | 0.03 |

TABLE 2-continued

| Preparation Conditions of Electrophotographic Photosensitive Members | | | | |
|---|---|---|---|---|
| | Photosensitive Layer | | | |
| | Charge Generating Layer | | Charge Transport Layer | Film Thickness of Undercoat Layer/ |
| Example No. | Type of Charge Generating Material | Film Thickness (μm) | Film Thickness (μm) | Film Thickness of Photosensitive Layer |
| Example 26 | GaPC | 0.15 | 20.00 | 0.06 |
| Example 27 | GaPC | 0.15 | 20.00 | 0.05 |
| Example 28 | GaPC | 0.15 | 20.00 | 0.05 |
| Example 29 | GaPC | 0.15 | 20.00 | 0.05 |
| Example 30 | GaPC | 0.15 | 20.00 | 0.05 |
| Example 31 | GaPC | 0.15 | 20.00 | 0.05 |
| Example 32 | GaPC | 0.15 | 20.00 | 0.05 |
| Example 33 | GaPC | 0.15 | 20.00 | 0.05 |
| Example 34 | GaPC | 0.15 | 20.00 | 0.05 |
| Example 35 | GaPC | 0.15 | 20.00 | 0.05 |
| Example 36 | GaPC | 0.15 | 20.00 | 0.05 |
| Example 37 | GaPC | 0.15 | 15.00 | 0.07 |
| Example 38 | GaPC | 0.15 | 25.00 | 0.04 |
| Example 39 | TiPC | 0.20 | 20.00 | 0.05 |
| Example 40 | Bisazo Pigment | 0.30 | 20.00 | 0.05 |
| Comparative Example 1 | GaPC | 0.15 | 20.00 | 0.05 |
| Comparative Example 2 | GaPC | 0.15 | 20.00 | 0.05 |
| Comparative Example 3 | GaPC | 0.15 | 20.00 | 0.05 |
| Comparative Example 4 | GaPC | 0.15 | 20.00 | 0.05 |
| Comparative Example 5 | GaPC | 0.15 | 20.00 | 0.05 |
| Comparative Example 6 | GaPC | 0.15 | 20.00 | 0.05 |
| Comparative Example 7 | GaPC | 0.15 | 20.00 | 0.15 |
| Comparative Example 8 | GaPC | 0.15 | 20.00 | 0.25 |
| Comparative Example 9 | GaPC | 0.15 | 20.00 | 0.50 |

Particles

TABLE 3

| Number Average Particle Sizes of Types of Particles | | | |
|---|---|---|---|
| Name in Table | Type | Manufacturer | Average Particle Size (μm) |
| METABLEN W-450A | Acrylic Rubber Particles | Mitsubishi Rayon | 0.20 |
| METABLEN S-2001 | Acrylic Rubber Particles | Mitsubishi Rayon | 0.20 |
| METABLEN E-901 | Acrylic Rubber Particles | Mitsubishi Rayon | 0.20 |
| METABLEN W-300A | Acrylic Rubber Particles | Mitsubishi Rayon | 0.10 |
| Kane Ace FM | Acrylic Rubber Particles | KANEKA | 0.20 |
| Kane Ace B | Butadiene Rubber Particles | KANEKA | 0.20 |
| XSK-5001 | Styrene/Butadiene Copolymer Rubber Particles | JSR | 0.50 |
| XER-91 | Acrylonitrile/Butadiene Copolymer Rubber Particles | JSR | 0.50 |
| SX866A | Styrene/Acrylic Copolymer Resin Particles having a Hollow Structure | JSR | 0.30 |

TABLE 3-continued

| Number Average Particle Sizes of Types of Particles | | | |
|---|---|---|---|
| Name in Table | Type | Manufacturer | Average Particle Size (μm) |
| ROPAQUE HP-1055 | Styrene/Acrylic Copolymer Resin Particles having a Hollow Structure | ROHM AND HAARS | 1.00 |
| TAFTIC FH-S | Cross-linked Polymethylmethacrylate Particles | TOYOBO | 0.50 |
| TOSPEARL 120 | Silicone Resin Particles | Momentive Performance Materials | 2.00 |
| Zinc Oxide | Zinc Oxide Particles | TAYCA | 0.07 |

Electron Transporting Material

Materials A101, A118, and A804 are as described above. Materials A201, A305, A404, A501, A602, A704, A902, and A1001 are respectively as follows in the above-mentioned general formulae (A2) to (A7), (A9), and (A10):

| | $R^{21}$ | $R^{22}$ | $R^{23}$ | $R^{24}$ | $R^{25}$ | $R^{26}$ | $R^{27}$ | $R^{28}$ | $Z^{21}$ | $R^{29}$ |
|---|---|---|---|---|---|---|---|---|---|---|
| A201 | H | H | 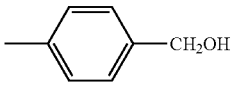 | H | H | H | H | H | O | — |

| | $R^{31}$ | $R^{32}$ | $R^{33}$ | $R^{34}$ | $R^{35}$ | $R^{36}$ | $Z^{31}$ | $R^{37}$ | $R^{38}$ |
|---|---|---|---|---|---|---|---|---|---|
| A305 | H | 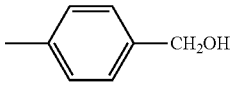 | H | H | 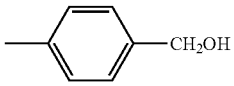 | H | C | CN | CN |

| | $R^{41}$ | $R^{42}$ | $R^{43}$ | $R^{44}$ | $R^{45}$ | $R^{46}$ | $Z^{41}$ | $R^{47}$ | $R^{48}$ |
|---|---|---|---|---|---|---|---|---|---|
| A404 | H | H | 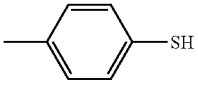 | 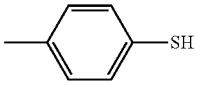 | H | H | C | CN | CN |

| | $R^{51}$ | $R^{52}$ | $R^{53}$ | $R^{54}$ | $R^{55}$ | $R^{56}$ | $R^{57}$ | $R^{58}$ | $Z^{51}$ | $R^{59}$ | $R^{60}$ |
|---|---|---|---|---|---|---|---|---|---|---|---|
| A501 | H | 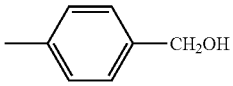 | H | H | H | H | H | H | C | CN | CN |

| A602 | $R^{61}$ | $R^{62}$ | $R^{63}$~$R^{66}$ |
|---|---|---|---|
| | 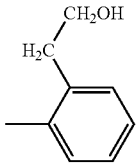 | H | H |

| | $R^{71}$ | $R^{72}$~$R^{74}$ | $R^{75}$ | $R^{76}$~$R^{78}$ |
|---|---|---|---|---|
| A704 | 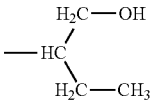 | H | 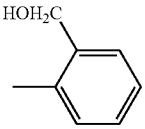 | H |

| | $R^{91}$ | $R^{92}$ | $R^{93}$ | $R^{94}$ | $R^{95}$ | $R^{96}$ | $R^{97}$ | $R^{98}$ |
|---|---|---|---|---|---|---|---|---|
| A902 | $-(CH_2)_2OH$ | H | H | H | H | H | H | H |

| | $R^{101}$ | $R^{102}$~$R^{104}$ | $R^{105}$ | $R^{106}$~$R^{109}$ | $R^{110}$ |
|---|---|---|---|---|---|
| A1001 | 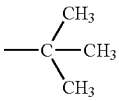 | H | $—CH_2—OH$ | H | 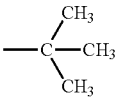 |

Cross-Linking Agent

The character after the colon in the tables specifies the type of a protective group. For example, "B1:H3" refers to "B1 protected by H3".

B1

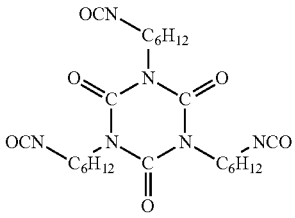

-continued

B4

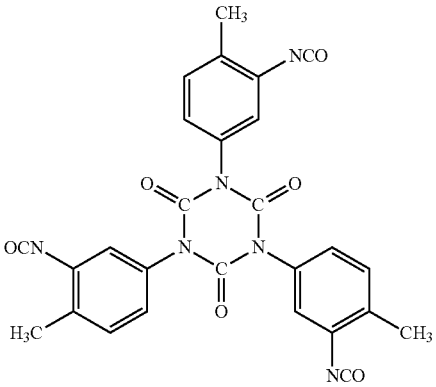

-continued

B5

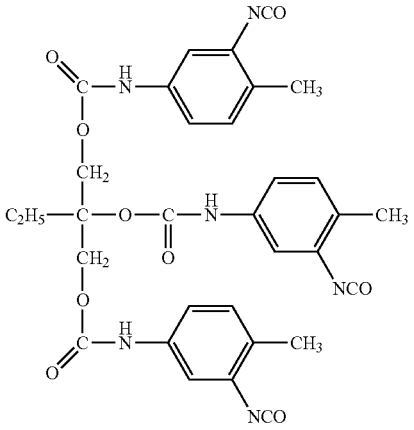

B7

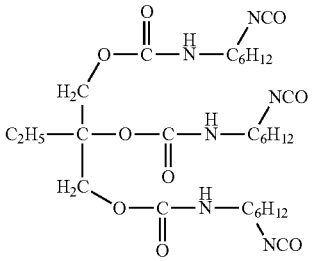

B12

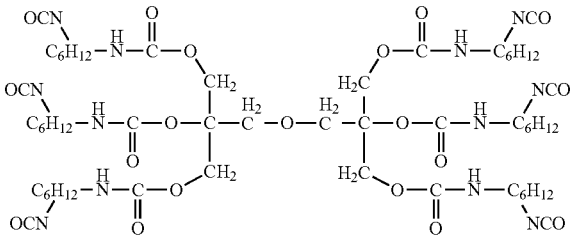

(Protective Group)

(H1)

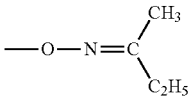

(H2)

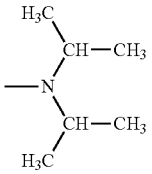

(H3)

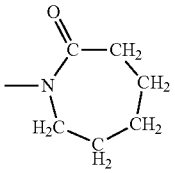

-continued

C1-1

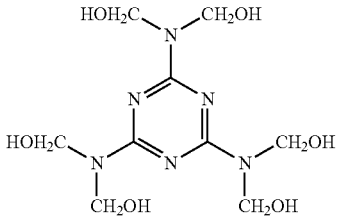

C1-3

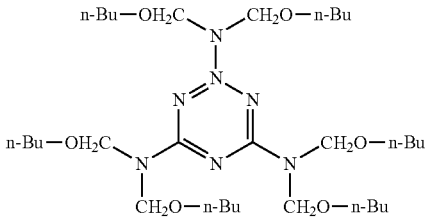

C1-9

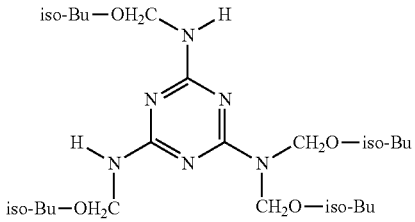

C2-1

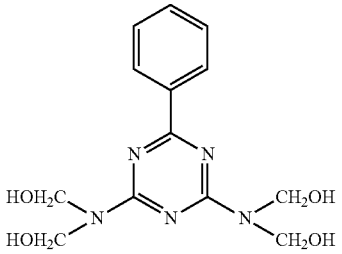

C3-3

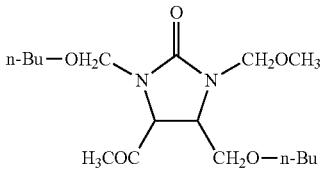

Resin

D1: a polyvinyl butyral resin having a hydroxyl group of 3.3 mmol/g (weight-average molecular weight: 100,000)

D2: a polyvinyl butyral resin having a hydroxyl group of 3.3 mmol/g (weight-average molecular weight: 20,000)

D3: a polyester resin having a hydroxyl group of 3.0 mmol/g (weight-average molecular weight: 80,000)

D4: a polyester resin having a hydroxyl group of 2.0 mmol/g (weight-average molecular weight: 5,000)

D5: a polyolefin resin having a hydroxyl group of 1.2 mmol/g (weight-average molecular weight: 600)

D6: a polyolefin resin having a hydroxyl group of 1.0 mmol/g (weight-average molecular weight: 100,000)

Charge Generating Material

TiPC: oxytitanium phthalocyanine having strong peaks at 9.0°, 14.2°, 23.9°, and 27.1° in Bragg angle (2θ±0.2°) by CuKα characteristic X-ray diffraction Bisazo pigment

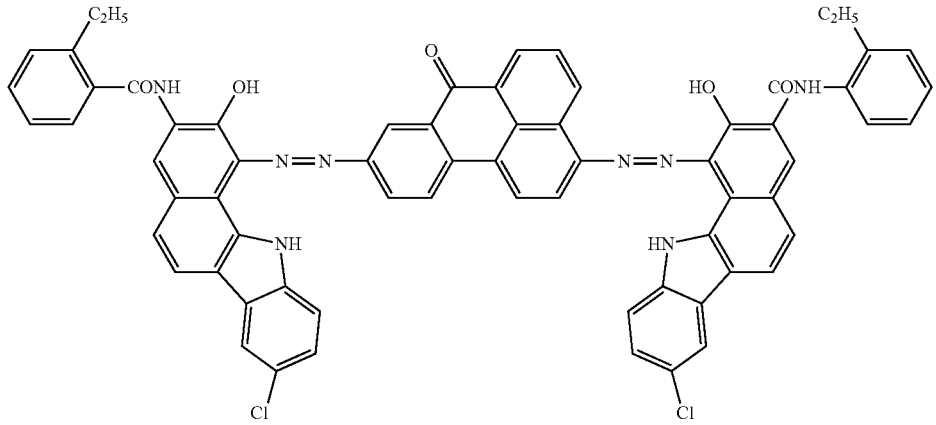

<Measurement of Martens Hardness of Undercoat Layer>

With respect to the electrophotographic photosensitive members prepared in the above-described ways, the Martens hardness was measured in the following method using an undercoat layer coating fluid used to prepare each photosensitive member, and the measured value was defined as the "Martens hardness of an undercoat layer". The measurement result is shown in Table 4.

The undercoat layer coating liquid was applied onto a glass plate, and the resulting coating film was heated at 160° C. for 40 minutes and polymerized to prepare a measurement sample with a film thickness of 3.0 μm. With regard to 10 portions of the sample, a microhardness measurement apparatus was used to measure the Martens hardness based on the indentation depth obtained by continuously applying load to an indenter, and the average value of the measured values was set as the "Martens hardness of an undercoat layer". PICODENTOR HM-500 (manufactured by Fischer Instrument) was used as the microhardness measurement apparatus to perform measurement in the environment of a normal temperature and a normal humidity, such as a temperature of 23° C. and a relative humidity of 50%.

(Conditions)

Indenter: a diamond indenter of the quadrangular pyramid shape with a face-to-face angle of 136° (Vickers indenter)

Maximum setting indentation depth: 0.3 μm

The time for which the load was continuously applied to the indenter: 30 seconds <Evaluation>

The electrophotographic photosensitive members prepared in the above-described ways were evaluated as follows in the environment of a low temperature and a low humidity, such as a temperature of 15° C. and a relative humidity of 10%.

(Evaluation of Adhesiveness)

A laser beam pi-inter "HP LaserJet Enterprise600 M603" (non-contact developing system, printing speed: 60 sheets of A4 portrait per minute) was modified and was then used to evaluate adhesiveness. To keep (regulate) the distance between the electrophotographic photosensitive member and the developer bearing member, a rotatable cylindrical distance-keeping member made from a polyoxymethylene material with a width of 4 mm was set to contact the electrophotographic photosensitive member around a position away about 9 mm from the upper and lower ends of the electrophotographic photosensitive member. The contact force was set to 30 newton (N). Under such conditions, an image with printing ratio of 1% was printed on 500,000 sheets of A4-size plain paper in an intermittent mode in which printing was stopped every time two printed sheets was output. The adhesive state between the undercoat layer and the photosensitive layer of the electrophotographic photosensitive member at a region contacting the distance-keeping member was visually observed to evaluate the adhesiveness with the photosensitive layer. The evaluation criteria were as follows. In the present exemplary embodiment, the samples that received evaluation scores A and B were deemed to be the ones in which the advantageous effects of the present exemplary embodiment were attained. The evaluation result is shown in Table 4.

A: There was no change in the photosensitive layer, so that adhesiveness was excellent.

B: Although slight uplifting was found in the photosensitive layer, adhesiveness was sufficient.

C: While uplifting was clearly found, there was peeling.

D: Peeling of the photosensitive layer was found.

<Evaluation of Ghost Prevention Effect>

A process cartridge for cyan of the above-mentioned laser beam printer was modified, and a potential probe (Model 6000B-8, manufactured by TREK Japan) was mounted at the developing position. Furthermore, the potential of the central portion of the electrophotographic photosensitive member was measured with the use of a surface potential meter (Model 344, manufactured by TREK Japan). The amount of light for image exposure was set in such a manner that, in the surface potential of a photosensitive drum, the dark area potential (vd) was −600 V and the light area potential (V1) was −200 V.

Positive ghosts were evaluated in the environment of a temperature of 23° C. and a humidity of 50% RH. First, a full-color image (a text image with a printing ratio of 1% for each color) was printed on 3,000 sheets of A4-size plain paper, and, after that, images were sequentially output in the order of one solid white image, five ghost evaluation images, one solid black image, and five ghost evaluation images.

Figure 2:
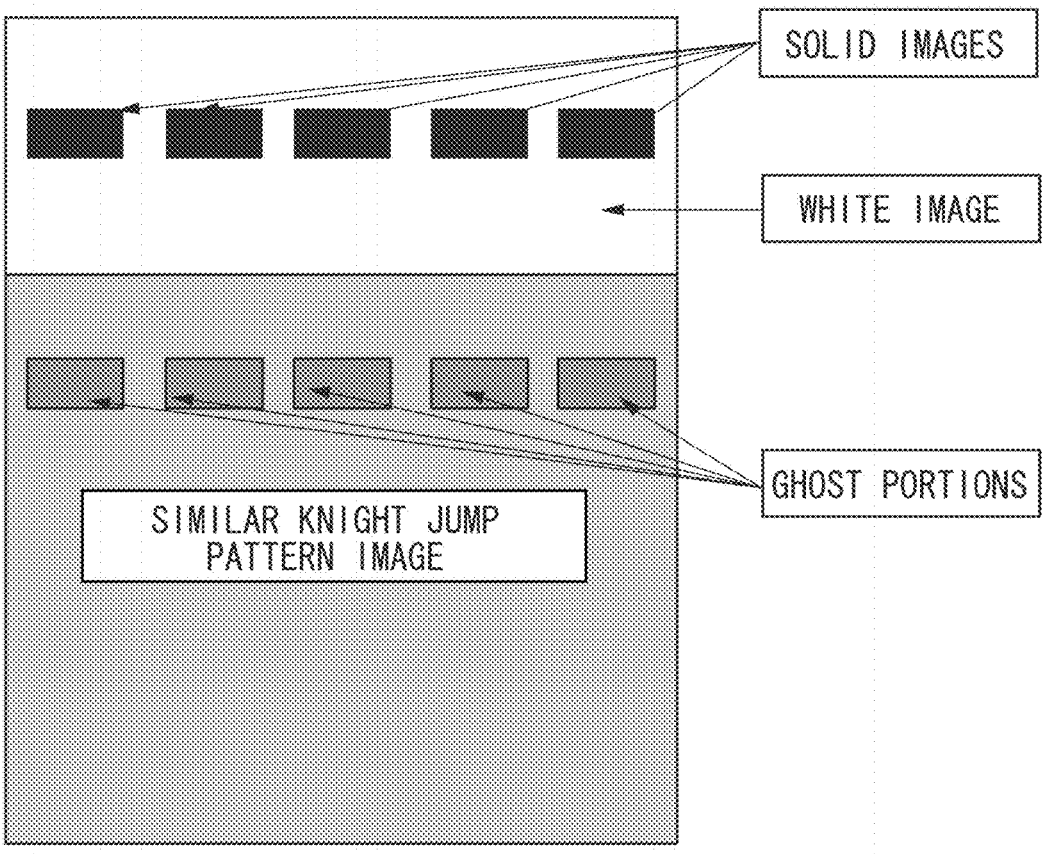
FIG. 2 illustrates an image for ghost image evaluation used in an exemplary embodiment.
Figure 3:
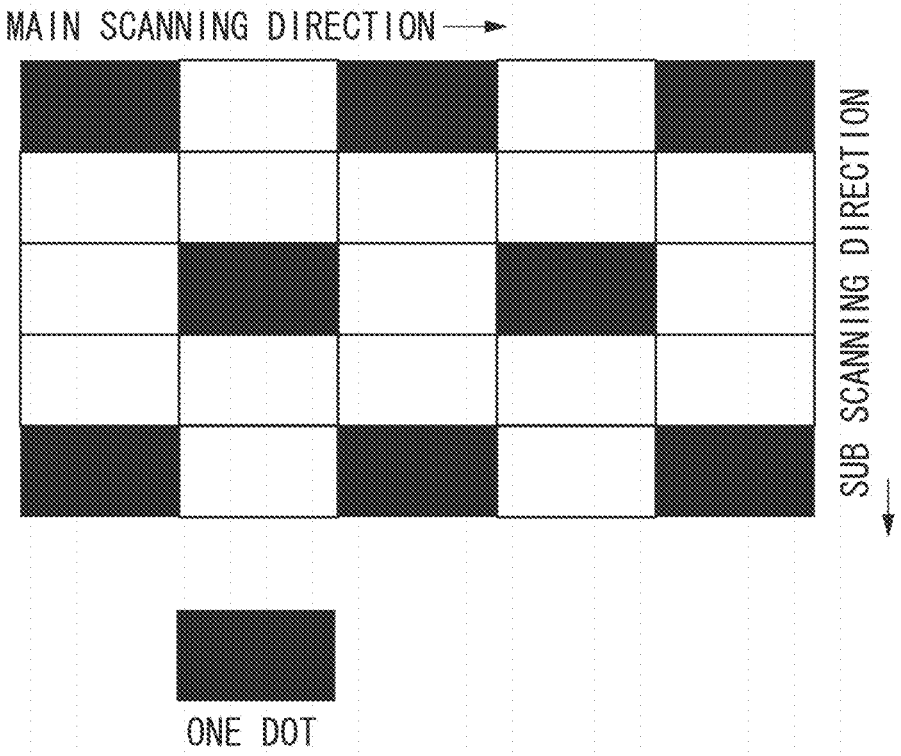
FIG. 3 illustrates a "halftone image with a similar knight jump pattern" illustrated in FIG. 2.

The ghost evaluation image is an image obtained by, after outputting rectangular "solid images" into a "white image" at the leading portion of the image as illustrated in FIG. 2, forming a "halftone image of similar knight jump pattern" illustrated in FIG. 3. Furthermore, in FIG. 2, "ghost portions" are portions at which a ghost caused by a "solid image" may occur.

The evaluation of a positive ghost was conducted by measuring a difference in density between the image density of a halftone image of similar knight jump pattern and the image density of a ghost portion. A spectrodensitometer (product name: X-RITE 504/508, manufactured by X-Rite) was used to measure density differences at 10 points in one ghost evaluation image. This measuring operation was performed on all of ten ghost evaluation images, so that the average in 100 points in total was calculated to evaluate a Macbeth density difference. The evaluation result is shown in Table 4.

TABLE 4

| Measurement and Evaluation Result | | | |
|---|---|---|---|
| | | Evaluation Result | |
| Example No. | Martens Hardness ($N/mm^2$) | Adhesiveness | Ghost Prevention Effect |
| Example 1 | 113 | A | 0.001 |
| Example 2 | 210 | B | 0.001 |
| Example 3 | 148 | A | 0.002 |
| Example 4 | 135 | A | 0.002 |
| Example 5 | 122 | A | 0.002 |
| Example 6 | 63 | A | 0.002 |
| Example 7 | 47 | B | 0.003 |
| Example 8 | 34 | B | 0.003 |
| Example 9 | 98 | A | 0.002 |
| Example 10 | 109 | A | 0.002 |
| Example 11 | 127 | A | 0.002 |
| Example 12 | 115 | A | 0.002 |
| Example 13 | 132 | A | 0.002 |
| Example 14 | 164 | B | 0.003 |
| Example 15 | 135 | B | 0.003 |
| Example 16 | 92 | A | 0.002 |
| Example 17 | 132 | B | 0.003 |
| Example 18 | 103 | A | 0.002 |
| Example 19 | 140 | A | 0.002 |
| Example 20 | 149 | A | 0.002 |
| Example 21 | 157 | A | 0.002 |
| Example 22 | 113 | A | 0.001 |
| Example 23 | 113 | B | 0.001 |
| Example 24 | 113 | A | 0.003 |
| Example 25 | 113 | A | 0.004 |
| Example 26 | 113 | B | 0.003 |
| Example 27 | 105 | A | 0.002 |
| Example 28 | 87 | A | 0.002 |
| Example 29 | 69 | A | 0.002 |
| Example 30 | 119 | A | 0.002 |
| Example 31 | 136 | A | 0.002 |
| Example 32 | 90 | A | 0.002 |
| Example 33 | 86 | A | 0.002 |
| Example 34 | 123 | A | 0.002 |
| Example 35 | 91 | A | 0.002 |
| Example 36 | 73 | A | 0.002 |
| Example 37 | 113 | A | 0.002 |
| Example 38 | 113 | A | 0.002 |
| Example 39 | 113 | A | 0.002 |
| Example 40 | 113 | A | 0.002 |
| Comparative Example 1 | 320 | D | 0.001 |
| Comparative Example 2 | 260 | D | 0.002 |
| Comparative Example 3 | 30 | D | 0.003 |
| Comparative Example 4 | 180 | C | 0.008 |
| Comparative Example 5 | 130 | A | 0.009 |
| Comparative Example 6 | 300 | D | 0.002 |
| Comparative Example 7 | 330 | D | 0.01 |
| Comparative Example 8 | 850 | D | 0.038 |
| Comparative Example 9 | 450 | D | 0.053 |

While the present disclosure has been described with reference to exemplary embodiments, it is to understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-094107 filed May 9, 2016, which is hereby incorporated by reference herein in its entirety.

What is claimed is:

1. An electrophotographic photosensitive member comprising:

an electrically conductive support member;

an undercoat layer; and a photosensitive layer adjacent to the undercoat layer in this order, wherein the undercoat layer contains a polymerized product of a composition including an electron transporting material having a polymerizable functional group, a cross-linking agent, and a thermoplastic resin having a polymerizable functional group, and at least one particulate material selected from the group consisting of polymer particles having a hollow structure, butadiene rubber particles, acrylic rubber particles, and acrylic/silicone complex rubber particles, wherein a content of the electron transporting material in the undercoat layer is 30% by mass or more with respect to a total mass of the composition, and wherein a content of the at least one particulate material in the undercoat layer is 20% by mass or more and 60% by mass or less with respect to the content of the electron transporting material.

2. The electrophotographic photosensitive member according to claim 1, wherein the polymer particles having a hollow structure are styrene/acrylic copolymer particles.

3. The electrophotographic photosensitive member according to claim 1, wherein a hollow volume ratio of the polymer particles having a hollow structure is 30% by volume or more.

4. The electrophotographic photosensitive member according to claim 1, wherein an average particle size of the at least one particulate material is 0.3 μm or less.

5. The electrophotographic photosensitive member according to claim 1, wherein an average particle size of the at least one particulate material is 1/10 or more and 1/3 or less of a film thickness of the undercoat layer.

6. The electrophotographic photosensitive member according to claim 1, wherein a film thickness of the photosensitive layer is 25 μm or less, and wherein a film thickness of the undercoat layer is 1/40 or more and 1/10 or less of the film thickness of the photosensitive layer.

7. The electrophotographic photosensitive member according to claim 1, wherein the content of the electron transporting material in the undercoat layer is 70% by mass or less with respect to the total mass of the composition.

8. The electrophotographic photosensitive member according to claim 1, wherein Martens hardness of the undercoat layer is 60 $N/mm^2$ or more and 150 $N/mm^2$ or less.

9. A process cartridge comprising:

an integrally supported electrophotographic photosensitive member; and at least one device selected from the group consisting of a charging device, a developing device, a transfer device, and a cleaning device, the process cartridge being detachably attachable to an electrophotographic apparatus, wherein the electrophotographic photosensitive member includes an electrically conductive support member, an undercoat layer, and a photosensitive layer adjacent to the undercoat layer in this order, wherein the undercoat layer contains a polymerized product of a composition including an electron transporting material having a polymerizable functional group, a cross-linking agent, and a thermoplastic polymer having a polymerizable functional group, and at least one particulate material selected from the group consisting of polymer particles having a hollow structure, butadiene rubber particles, acrylic rubber particles, and acrylic/silicone complex rubber particles, wherein a content of the electron transporting material in the undercoat layer is 30% by mass or more with respect to a total mass of the composition, and wherein a content of the at least one particulate material in the undercoat layer is 20% by mass or more and 60% by mass or less with respect to the content of the electron transporting material.

10. An electrophotographic apparatus comprising:

an electrophotographic photosensitive member;

a charging device;

an exposure device;

a developing device; and a transfer device, wherein the electrophotographic photosensitive member includes an electrically conductive support member, an undercoat layer, and a photosensitive layer adjacent to the undercoat layer in this order, wherein the undercoat layer contains a polymerized product of a composition including an electron transporting material having a polymerizable functional group, a cross-linking agent, and a thermoplastic polymer having a polymerizable functional group, and at least one particulate material selected from the group consisting of polymer particles having a hollow structure, butadiene rubber particles, acrylic rubber particles, and acrylic/silicone complex rubber particles, wherein a content of the electron transporting material in the undercoat layer is 30% by mass or more with respect to a total mass of the composition, and wherein a content of the at least one particulate material in the undercoat layer is 20% by mass or more and 60% by mass or less with respect to the content of the electron transporting material.

* * * * *